US006258179B1

(12) United States Patent
Takayama et al.

(10) Patent No.: US 6,258,179 B1
(45) Date of Patent: Jul. 10, 2001

(54) CARBURIZED PARTS, METHOD FOR PRODUCING SAME AND CARBURIZING SYSTEM

(75) Inventors: Takemori Takayama; Naoji Hamasaka, both of Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/131,776

(22) Filed: Aug. 10, 1998

(30) Foreign Application Priority Data

Aug. 11, 1997 (JP) ..... 9-230389
Nov. 5, 1997 (JP) ..... 9-320482

(51) Int. Cl.[7] ..... C23C 8/22; C23C 8/26; C23C 8/32

(52) U.S. Cl. ..... 148/233; 148/235; 148/218; 148/225; 148/216; 148/319

(58) Field of Search ..... 148/219, 216, 148/233, 235, 225, 319

(56) References Cited

U.S. PATENT DOCUMENTS 4,288,062 * 9/1981 Gupta et al. ..... 266/88
5,868,871 * 2/1999 Yokose et al. ..... 266/252

FOREIGN PATENT DOCUMENTS

359159928 * 9/1984 (JP) ..... 148/233
359232252A * 12/1984 (JP) .
362093348A * 4/1987 (JP) .
62-24499 5/1987 (JP) .
6-17224 1/1994 (JP) .
6-17225 1/1994 (JP) .
6-25823 2/1994 (JP) .
10-176219 6/1998 (JP) .

* cited by examiner

*Primary Examiner*—Deborah Yee
(74) *Attorney, Agent, or Firm*—Armstrong, Westerman, Hattori, McLeland & Naughton LLP

(57) ABSTRACT

A carburizing method is described which is capable of dispersing cementite grains in the surface of steel uniformly and finely as not to affect fatigue strength and capable of fining the crystal grains of austenite. To prevent cementite precipitation during high temperature carburization at 980° C. or more, steel contains Al in an amount in the range of 0.05≦[Al wt %]≦2.0 and Cr in an amount in the range of 0.3≦[Cr wt %]≦4.0, and the composition of the steel satisfies the requirement represented by 1.9≧−5.6[Si wt %]−7.2[Al wt %]+1.1[Mn wt %]+2.1[Cr wt %]−0.9[Ni wt %]+1.1[Mo wt %]+0.6[W wt %]+4.3[V wt %].

17 Claims, 27 Drawing Sheets

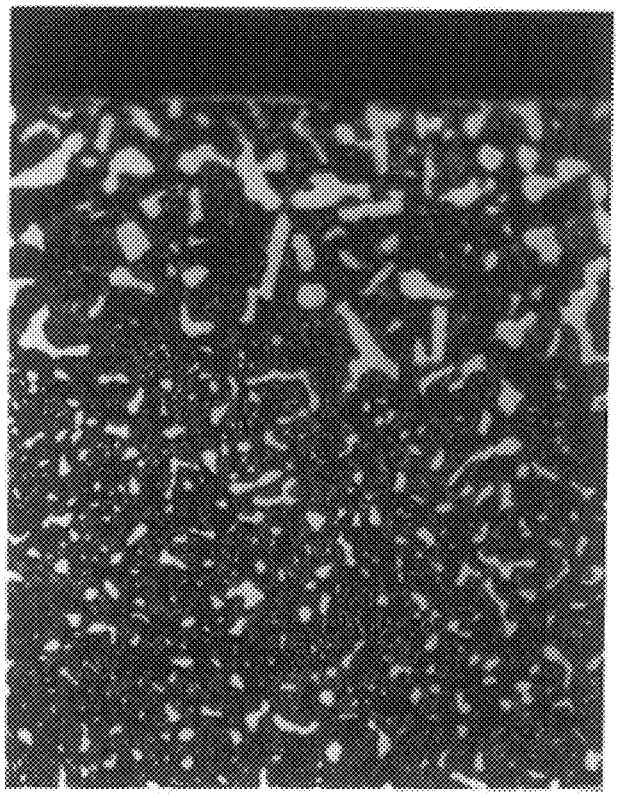
FIG.5 (a) x400
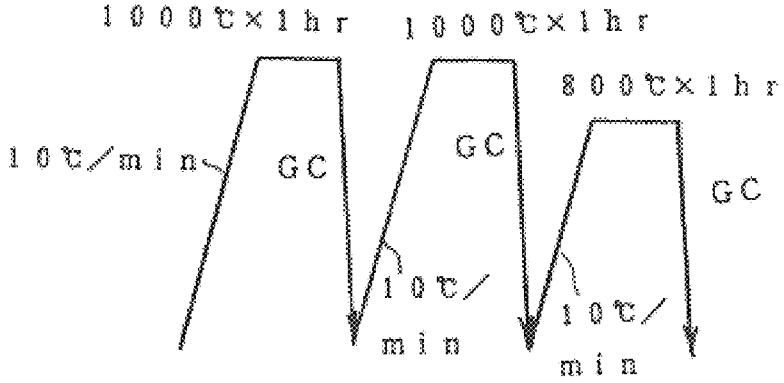
FIG.5 (b) GC : COOLING BY 600 TORR $N_2$ GAS

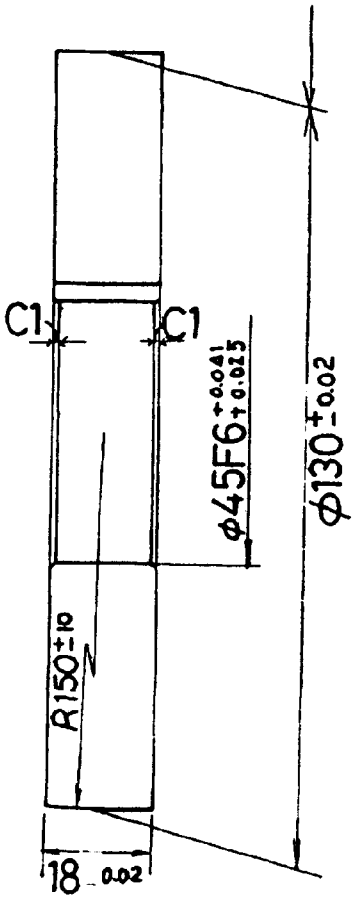
FIG.8 (b) LARGE ROLLER SPECIMEN
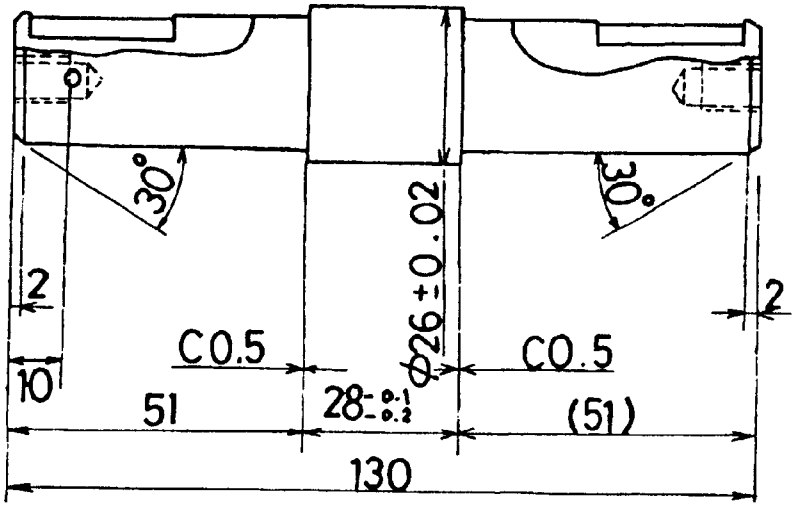
FIG.8 (a) SMALL ROLLER SPECIMEN

×400

×400

×2000

×400

GRAIN SIZE OF CEMENTITE PRECIPITATING DURING HIGH TEMPERATURE CARBURIZATION (2-5)

SURFACE 0.05

0.10

×400

×400

×400

CARBURIZED PARTS, METHOD FOR PRODUCING SAME AND CARBURIZING SYSTEM

TECHNICAL FIELD

The present invention relates in general to carburized parts, methods for producing same and carburizing systems. The invention deals more particularly with an improved method for carburizing or carbonitriding steel at higher efficiency, and with a method for uniformly diffusing and precipitating fine cementite alone or together with fine nitrides in high percentage on the surface of steel by incorporating the above carburizing and carbonitriding method. The invention further relates to carburized parts such as rolling steel parts and their production method and carburizing system, which utilize the above carburizing and carbonitriding method for promoting the diffusion of cementite and nitrides.

BACKGROUND ART

In a typical known carburizing method, a workpiece is carburized in a carburizing atmosphere with a carbon potential equivalent to Acm transformation temperature or less, after raising temperature to the carburizing temperature range. Then, carbon is further diffused at the same temperature and with a carbon potential of 0.7 to 0.9 wt %. After temperature is lowered to about 850° C., the workpiece is quenched. Alternatively, the workpiece once cooled subsequently to the prior diffusion process is heated again to about 850° C. and then quenched (reheating hardening).

In recent years, high-temperature carburization is attempted, in which RX gas and butane gas are used as carrier gas and enriched gas respectively and such RX gas carburization is performed at a high temperature of 950° C. to 1,000° C. in order to increase the yield of carburized or carbo-nitrided steel. As other known high-temperature carburizing methods, the following carburization techniques are taken at high temperatures: (a) vacuum carburization in which carburization and diffusion are carried out in a reducing atmosphere in which hydrocarbon gas is decomposed at a reduced pressure; (b) $N_2$-base carburization in which carburization and diffusion are carried out in an atmosphere in which $N_2$ gas mixed with hydrocarbon gas is heat-decomposed. The RX gas carburization method and $N_2$-base carburization method often use a continuous carburizing furnace to enable mass production. In the above methods, a target value of the carbon content at the surface of the carburized layer after carburization is such a value with which 0.7 to 0.9 wt % an eutectoid constituent can be achieved and, generally, there are precipitated no carbides on the surface of the carburized layer.

A special carburization technique, high-carbon carburization is also known, in which two or more carburizing cycles are repeated, at least one of which is carried out in an atmosphere with a carbon content equivalent to Acm transformation temperature or more so that carbides are dispersed in the surface layer of steel. This technique aims to increase the rolling strength of steel parts and an example of which is disclosed in Japanese Patent Publication (Kokoku) No. 62-24499 (1987). According to one embodiment of this publication in which RX gas carburization is incorporated, a workpiece is pre-carburized for 6 to 12 hours at a temperature ranging from 930 to 980° C. with a carbon potential in the range of from the eutectoid carbon content to the value equivalent to Acm transformation temperature. After cooled by air or quenched once, the workpiece is again heated by raising temperature at a rate of 20° C./min. or less to a re-carburizing temperature of 750 to 950° C. Subsequently, carburization is carried out for 6 hours at 900° C. while the carbon potential (=1.85) equivalent to Acm transformation temperature or more being maintained, whereby 30% by volume or more cementite is precipitated in the carburized surface layer of 0.1 mm. In addition to the description of the above carburizing technique, the publication has reported that the steel having 30% by volume or more cementite precipitates exhibits superior rolling life. In the high-carbon carburization which causes cementite diffusion, the steel workpieces are required to contain 0.5 wt % or more Cr in most cases, as disclosed in Japanese Patent Publication (Kokai) No. 6-17225 (1994).

Since a problem presented by the prior art RX gas carburization method lies in the carburization reaction based on CO—$CO_2$ gas, there is inevitably created a grain boundary oxidized zone or imperfect hardened zone on the surface layer of steel after carburization, which results in, when taking a gear for example, decreases in the bending strength of the dedendums and in the strength of the tooth flanks. Due to the recent trend towards more compactness and higher load caused by transmitted power in reduction gears, there arise demands for a carburizing method which is able to prevent oxidization reaction under a carburizing atmosphere.

Carburization treatment in which the carbon content of the surface of a workpiece is controlled by controlling the amount of $CO_2$ in a carburizing atmosphere is usually carried out at a temperature of 900 to 950° C., because it is extremely difficult to control carbon potential by controlling the amount of $CO_2$ under high-temperature carburizing conditions. This inevitably involves long processing time. For example, it is well known that treatment of large gears takes two or more days and therefore incurs very high treatment cost. In addition, prolonged carburization treatment often causes an increase in the depth of a grain boundary oxidized zone or imperfect hardened zone so that the tooth flanks must be ground in some cases, resulting in a further increase in the cost of manufacture of gears.

When performing the above RX gas carburization at high temperatures for instance, for adjusting carbon potential to 1.5±0.1 during a carburization phase at a temperature of 1,000° C., the amount of $CO_2$ in the furnace must be controlled within the range of about 0.035 to 0.045%. For adjusting the carbon content of the surface to 0.8±0.1 wt % during a diffusion phase, the amount of $CO_2$ must be controlled within the range of 0.1±0.02%. For adjusting the carbon content of the surface to 1.5±0.1 wt % during carburization at a temperature of 1,100° C., the amount of $CO_2$ must be within the range of 0.015 to 0.020%, and for adjusting the carbon content of the surface to 0.8±0.1 wt %, the amount of $CO_2$ must be within the range of 0.035 to 0.05%. As understood from above, there are many problems in the control of carbon potential.

As attempts to solve the problems suffered by the above RX gas carburization method such as prolonged treatment and the creation of abnormal surface layers (e.g., a grain boundary oxidized zone), there have been proposed the vacuum carburization method and the $N_2$-base carburization method, in which carburization is performed in an atmosphere of hydrocarbon gas having a pressure of about 10 torr or less. However, the vacuum carburization method reveals the problem that even if the amount of $CH_4$ within the furnace is measured and controlled, it cannot be used as an index for carbon potential and therefore $CH_4$ needs to be added in an amount several times to several tens of times more than a theoretical value during carburization. This method thus fails in practically controlling carbon potential so that precipitation of coarsened cementite on the carburized surface layer cannot be prevented during carburization. Although some measures have been taken to avoid these undesirable results, for example, by stopping a supply of carburizing gas in the course of carburization to effect diffusion treatment for a specified period, these techniques are taken under various operating conditions which are determined according to the depth of carburization, the type of steel used and others, as described in the reference book written by Takeshi Naito. That is, the determination of operating conditions is highly dependent on the know-how, which leads to instability in quality, high maintenance cost for the system, and involvement of vacuum troubles. For adjusting the carbon content of the surface to 0.7 to 0.9 wt % in order to prevent the precipitation of platy pro-eutectoid cementite by cooling after carburization, the time required for diffusion should be, in general, two or three times the time required for carburization. This could be a chief factor for decreasing productivity particularly when a great depth of carburization is needed for instance in the case of large-sized gears.

The vacuum carburizing method suffers from the problem of soot produced by the decomposition of hydrocarbon gas. When treating a large number of parts, carburization under vacuum such as about 10 torr tends to entail carburization nonuniformity in the parts and therefore requires use of a larger amount of hydrocarbon gas, resulting in increased soot generation. Further, accumulating soot causes a lot of mechanical problems in performing continuous vacuum carburization.

With a view to preventing the grain boundary oxidation mentioned above, various $N_2$-base carburization techniques have been proposed. These techniques restrict oxidizing gas as much as possible but suffer from the same problem as that of the RX gas carburizing method in terms of carbon potential controllability, since the control of carbon potential during carburization in these techniques is performed by controlling the amount of $CO_2$ gas.

Continuous carburization furnaces are often used for the purpose of increasing the productivity of the RX gas carburizing method and the $N_2$-base carburizing method. The continuous type is useful in dealing with a large number of parts under the same carburizing conditions but reveals ineffectiveness in the production of few-of-a kind parts which is prevailing in the recent trend. Even if continuous treatment is carried out with the vacuum carburization method, the same problem as noted above will be encountered in the production of few-of-a kind parts.

Coarsening of the crystal grains of austenite in steel during carburization is a common problem for all the high-temperature carburizing methods described above. It is anticipated that when such steel is used for producing a gear, the bending strength of the dedendums significantly decreases. Therefore, fining treatment is needed for the crystal grains of austenite, which is a disadvantage in adopting any of the high-temperature carburizing methods.

As a means for improving the strength of a rolling tooth face in carburization, there has been proposed the technique for dispersing cementite in an amount of 30 percent by volume or more, as noted earlier. Where the average grain size of cementite to be dispersed and precipitated is not precisely controlled like Japanese Patent Publication (Kokoku) No. 62-24499 (1987), the dispersed coarse cementite promotes the concentration of bending stress imposed on the dedendums and, in consequence, decreases the bending strength of the dedendums. This is a serious problem particularly in the technique of the publication in which carburization is carried out, precipitating carbides at a temperature of 950° C. or less, while maintaining carbon potential at a value equivalent to Acm transformation temperature or more. In this technique, since the cementite at the outermost surface tends to be extremely coarsened and since carbides precipitate and aggregate in the grain boundary, not only the bending strength extremely deteriorates, but also the contact surface pressure strength is adversely affected. It is a particularly serious problem that decreases in contact surface pressure strength become more significant in high-speed rotating gears.

As described in the reference book written by Takeshi Naito, dispersion/precipitation of a carbide (cementite) in the carburized surface layer can be caused by repeatedly performing vacuum carburization cycles. In this case, cementite preferentially precipitates in the grain boundary like the other methods, and the cementite aggregates, creating coarse cementite grains which result in a considerable decrease in bending strength.

It is conceivable to add large amounts of alloying elements such as Cr or to lower re-carburization temperature in order to fine the precipitated cementite. However, the former case has the disadvantages that cementite precipitation occurs during the preceding high temperature carburization and that use of expensive steel is involved, whereas the latter case prolongs re-carburization time excessively, resulting in higher cost.

The present invention is directed to overcoming the foregoing problems and therefore aims to provide a method in which cementite grains fine enough not to substantially adversely affect fatigue strength are uniformly dispersed in the surface layer of steel and in which austenite crystal grains can be fined, this method being enabled by specifying the way of high temperature carburization and the constituents of steel to be used.

Further, the invention aims to provide a carburization system capable of providing high productivity and effectively dispersing finer cementite grains by employing carburizing methods improved over the above-discussed high temperature carburizing methods and re-carburizing methods.

DISCLOSURE OF THE INVENTION

The means for finely dispersing cementite grains in the carburized layer, which is the prime object of the invention, is designed such that while precipitation of coarse cementite grains during carburization being prevented by high-temperature carburization, surface carbon content is rapidly increased up to 1.2 to 2.0 wt % and carbon is allowed to penetrate up to a specified depth and such that a large amount of fine cementite grains is precipitated in the carburized layer by reheating and these fine cementite grains are utilized to make austenite crystal grains finer thereby increasing rolling fatigue strength and bending fatigue strength. During the reheating phase, carburization, carbonitriding and/or nitriding are carried out so as not to coarsen cementite, cementite, nitrides and/or carbon nitrides are finely precipitated, and residual austenite is created in high volume percentage, whereby rolling fatigue strength can be further increased.

First of all, the relationship between steel materials to be used and a high temperature carburizing method which does not cause cementite precipitation will be explained according to the prime aspect of the invention.

As has been noted earlier, the difficulty of carburization free from cementite precipitation by use of the high temperature RX gas carburizing method under high carbon potential conditions is attributable to the difficulty in controlling $CO_2$ gas concentration and to the fact that carburizing power increases with temperature. As the first aspect of the invention resides in carburization which provides the carbon content in the surface of the carburized layer in the range of from 1.2 wt % to the maximum solid solubility of carbon which does not cause cementite precipitation, we experimentally studied to achieve high temperature carburization which can be carried out under the condition that surface carbon activity during carburization is approximately 1. As a result, it has been found that when carburization is performed with a small amount of the carbon precipitate within the furnace in a thermal decomposition atmosphere containing hydrocarbon gas such as propane and methane, the surface of carbon steel is carburized with a carbon activity of approximately 1, and that cementite precipitation can be prevented by adjusting the amount of Al contained in steel material, even in the case of case hardening steel containing carbide forming elements such as Cr. Therefore, in the invention, high temperature carburization (980 to 1,100° C.) was performed in the above shooting state, using various steel materials which were mainly used for producing case hardening steel and contained various alloying elements in various compound ratios. In each steel sample, cementite precipitation on the surface was checked and steel composition requirement for avoiding cementite precipitation when carburization is carried out in an atmosphere with a carbon activity of approximately 1 was established as follows. Although the effect of addition of Al can be admitted when the amount of Al is 0.05 wt % or more, the amount of Al is more preferably 0.1 wt % or more and the total Par of the effects of alloying elements is preferably 1.5 or less.

$$1.9 \geqq -5.6[\text{Si }\%]-7.2[\text{Al }\%]+1.1[\text{Mn }\%]+2.1[\text{Cr }\%]-0.9[\text{Ni }\%]+1.1[\text{Mo }\%]+0.6[\text{W }\%]+4.3[\text{V }\%]=\text{Par}$$

It is presumed from the above formula that, cementite precipitation during high temperature carburization can be prevented by adding 0.6 wt % Al even when Cr which easily binds to carbon is added in an amount of 3.0 wt %. This enables addition of Cr in large amounts, which is useful for the precipitation of fine cementite grains in the later step.

It has been found that addition of Ni, Al and Si (which are not carbide forming elements) in large amounts is useful particularly for preventing cementite precipitation. Therefore it is preferred to add these elements as far as requirements for steel composition and manufacture cost are satisfied. Preferably, the amounts of Ni and Al are 5 wt % or less and 2 wt % or less, respectively. In the reheating situation where a large amount of the cementite precipitate on the carburized surface, carbide forming elements such as Cr, Mo and V having the function of increasing hardenability condense within cementite and the amount of these alloying elements in the parent phase of austenite decreases, resulting in decreased hardenability. Therefore, it is desirable for ensuring the hardenability of the parent phase to utilize Ni, Al and Si which are expelled from cementite and condense within the parent phase of austenite. Al is especially useful because it exerts the most desirable effects in view of prevention of cementite precipitation during high temperature carburization and improvement of hardenability. In the invention, it is regarded desirable to add Al in an amount of 0.05 wt % or more. When Al is added in amounts of 0.2 wt % or more, it is observed that Al restrains martensitic transformation in a gas cooling phase after high-temperature carburization while allowing a bainitic structure having high tenacity to precipitate preferentially and markedly preventing cementite precipitation due to cooling. This effect is significant when the amount of Al is 0.35 wt % or more. Therefore, addition of 0.35 wt % Al is desirable particularly when there is the danger of possible deformation or cracking in the tooth tip corners of a gear owing to rapid cooling with gas.

When carbonitriding is performed after high temperature carburization, cooling and reheating, Al actively forms a nitride on the surface of steel, reacting with nitrogen which penetrates from the atmosphere so that the action of Al relative to the carbon activity is significantly reduced. This, as a result, increases the effect of Cr for promoting fine cementite precipitation.

As understood from the above formula, V exerts a more remarkable cementite fining effect than Cr, but binds to carbon contained in the steel, strongly forming a carbide. Therefore, where the conventional carburization temperature range is adopted, even if a large amount of V is added, the amount of V which actually, effectively works in fining cementite is about 0.2 wt %. The amount of effective V can be increased up to 0.6 wt % by high temperature carburization so that V can be further effectively utilized in the precipitation of fine cementite during the phases of cooling, reheating, re-carburization, and carbo-nitriding which are sequentially performed after carburization.

The purpose of incorporating high-temperature carburization in the invention resides in condensing, in a short time, the carbon of the carburized layer to provide carbon content within the range of from 1.2 wt % to the maximum value which does not cause cementite precipitation and resides in increasing the depth of carburization. For example, where high temperature carburization is carried out at 1,040° C. for 1 hour, the maximum solid solubility of carbon is 1.7 wt %. Using steel containing 0.2 wt % carbon in an atmosphere having a carbon activity of approximately 1, this high temperature carburization (1,040° C.×1 hr) was compared to the ordinary carburization at a temperature of 930° C. for 1 hour, in terms of the depth of the region having a carbon content of 0.4 wt %. The depth of the former case is 2.3 times the depth (about 0.5 mm) of the latter case. Further, comparison was made between these cases in terms of the depth of the region having a carbon content of 1.2 wt %. The depth of the latter case (930° C.×1 hr) was found to be 0 mm whereas the depth of the former case (1,040° C.×1 hr) was 0.4 to 0.5 mm.

When high temperature carburization is performed under an atmosphere with a carbon activity of 1, it is preferred to employ the vacuum carburizing method for carrying out carburization under reduced pressure or the method for carrying out carburization under an atmosphere of inert $N_2$ gas to which carburizing gas such as propane or methane gas is added, thereby generating a minute amount of soot. For instance, when employing vacuum carburization carried out under reduced pressure (reduced pressure carburization), carburization is thought to be caused by radical carbon generated through the decomposition represented by the following equations (1) and (2) and therefore, carburizing power increases under reduced pressure according to Le Chatelier law. In addition, the decomposition reaction of hydrocarbon gas such as propane or methane is considerably expedited under reduced pressure by employing the carburization temperature of the high temperature zone and a minute amount of the hydrocarbon gas also promotes carburization, so that the cost of gas needed for the carburization phase can be reduced.

$$Fe+C_3H_8=Fe-C+4H_2 \quad (1)$$

$$Fe+CH_4=Fe-C+2H_2 \quad (2)$$

It is disclosed in Japanese Patent Publication (Kokai) No. 52-66838 (1977) that carbon activity can be controlled by controlling, for example, hydrogen gas concentration according to the above equations based on the measurement of the partial pressure of hydrogen gas and the partial pressure of propane or methane gas under reduced pressure. However, it is known that practical, reaction response for control cannot be obtained unless the decomposition reaction occurs under substantially reduced pressure (e.g., approximately $10^{-1}$ torr) so that it becomes necessary to add methane in amounts several times more than the amount for keeping methane equilibrium pressure, as pointed out in the reference book written by Takeshi Naito.

In reality, the control of carbon activity based on the measurement of the partial pressure of methane and hydrogen gasses is not practically effective, taking into account the fact that soot generation, which actually affects the vacuum carburizing operation, does not occur under a reduced pressure of 10 torr or less. It is also well known that if uniform quality cannot be ensured for carburized parts because of low gas concentration in vacuum carburization under a pressure of 10 torr, the quality of the parts can be significantly improved by adding an inert gas such as $N_2$ to raise the pressure of the atmosphere to 50 torr or more. After repeatedly conducting carburization tests under the above-noted reduced pressures, we found that when carbon activity in the carburizing atmosphere exceeds 1, sooting occurs prior to the occurrence of carburizing reaction, and that with extremely low carburizing power and carbon activities exceeding 1, the precipitation of coarse cementite grains during the high temperature carburization phase can be prevented by adjusting the composition of steel as described earlier. Therefore, according to the invention, it is preferred to adjust carbon activity to be approximately 1, by controlling the practical sooting phenomenon. It should however be noted that when continuously performing high temperature carburization for a long time, the problem of carbon soot accumulating during this long period must be solved. In the invention, this problem is solved by a carburization system designed to remove the soot by introducing a weak oxidizing gas such as $CO_2$ gas into a carburizing chamber during carburization operation.

For controlling soot generation during the high temperature carburization phase as described above, several means are conceivable. For example, precipitating carbon may be promptly oxidation-removed or the composition of gas is adjusted so as to restrict carbon precipitation. We found the following matters from a study of the relationship represented by Equations (3) to (5).

$$CO_2+C=2CO \quad (3)$$

$$CH_4+CO_2=2CO+2H_2 \quad (4)$$

$$CH_4+C=C+2H_2 \quad (5)$$

① The reaction represented by Equation (4) occurs most promptly when $CO_2$ gas is pulsed into the decomposition gas of hydrocarbon gas that is generating soot. It is effective that the methane gas, which is the sooting source, is transformed into highly reducible $CO+H_2$ gas and then, the existing carbon is transformed into CO gas according to Equation (3). Preferably, while soot generation being interrupted, soot removal is carried out at a rate much higher than the precipitation rate of carbon generated from methane, which is represented by Equation (5). It has been found that carburization temperature should be set at at least 980° C. or more, in order to remove the already generated carbon at a rate higher than the precipitation rate of carbon generated from methane (see FIG. 1).

② Taking the cost of gas used during the carburization phase into account, it is very effective that, in the basic situation where the Boudouard Reaction described by Equation (3) occurs under reduced pressure, the above-described carburization is carried out in an atmosphere containing a little soot by utilizing the rapid oxidation reaction between methane and $CO_2$ as described by Equation (4). With this, the emergence of a grain boundary oxidized layer after carburization can be prevented. Note that when the carbon activity is 1 under the condition that RX gas comprising 24% CO, 29% $H_2$ and 47% $N_2$ is in Boudouard equilibrium at a pressure of 250 torr and temperature of 1,000° C. for instance, the concentration of existing $CO_2$ is about 40 ppm, which presents substantially no risks for causing grain boundary oxidation. If the pressure is reduced to 50 torr in the above situation, further uniform carburization can be assured, increasing safety. By introducing a minute amount of hydrocarbon gas into the above situation, excessive soot generation can be prevented through the reaction of Equation (4) so that carbon activity can be controlled to be approximately 1. The same effect can be achieved by using, as carburizing gas, alcohol (e.g., methanol) or acetates in place of RX gas. As the carburizing gas, not only methane and propane, but also other hydrocarbon gases such as butane and acetylene may be used.

③ The heater part of a furnace is higher in temperature than the other parts of the furnace and therefore carbon is more likely to precipitate at the heater part, owing to hydrocarbon gas (e.g. $CH_4$) contained in the carburizing gas, which comes in direct contact with the heater part.

④ Introduction of weak oxidizing gas such as $CO_2$ promotes the fatigue of the heater part, involving more system troubles.

A system constructed according to the invention has an improved heater in a carburization heating chamber as shown in FIG. 2. With this arrangement, if carbon precipitation occurs within the furnace in the event of accident or if carbon accumulates due to long use, carbon precipitant can be easily oxidation-removed by addition of $CO_2$. Additionally, soot removal by use of $CO_2$ is possible during loading of workpieces for the next cycle after completion of one carburization cycle. Note that the system has a heater protecting tube that is so constructed as to allow a flow of inert gas such as $N_2$ gas and to have ends at least either of which should be unfixed because if both ends are fixed, damage due to heat stress created during heating cycles is unavoidable.

It is preferred to use a mass spectrometer as a gas sensor for the carburizing gas atmosphere described above, for the following reasons. First, the degree of vacuum within the mass spectrometer is in an order of $10^{-7}$ torr and therefore the furnace gas under reduced pressure can be easily directly introduced into the mass spectrometer. Secondly, hydrogen (2), methane (16), $H_2O$ (18) and carbon (12) and the like can be clearly, independently detected by a mass spectrometer as seen from the result of the gas analysis shown in FIG. 3 where propane having a pressure of 0.2 torr was decomposed at a temperature of 1,000° C. The gas concentration is controlled by utilizing an analysis obtained by the mass spectrometer and the relationship shown in FIG. 1, whereby carburization can be carried out with a carbon activity of approximately 1, while preventing soot generation.

For controlling the surface carbon content during the above-described high temperature carburization within the range of 1.2 to 2.0 wt %, it is the easiest way to control high temperature carburization temperature. Taking productivity into account, the following measure may be taken for reducing the carbon content at the outermost surface layer: i) The carburizing atmosphere is cut off after the high temperature carburization and diffusion is carried out for a period that is one half of the carburization time, whereby the carbon content during the high temperature carburization is controlled within the range of from the value equivalent to a carbon activity of 1 to 0.8. ii) After the high temperature carburization, weak oxidizing gas such as $CO_2$ is introduced into the carburizing atmosphere thereby controlling soot generation so that decarbonization occurs very quickly in the outermost surface layer. iii) More effects can be expected by taking, at a high carburizing temperature, the above measures i) and ii) in which the carburizing atmosphere is cut off or adjusted after the high temperature carburization. For example, the effects of the measures i) and ii) can be fully achieved by increasing temperature by up to 50° C.

Next, the grain size of austenite after the high temperature carburization will be explained.

It is generally known that when steel is heated at a high temperature of 950° C. or more, the crystal grains of austenite are markedly coarsened and this is usually prevented by addition of a minute amount of Nb. However, if steel is heated at more than 1,000° C., the preventing effect of such addition decreases extremely. For example, SNCM420H-0.05Nb steel is remarkably coarsened to a grain radius of 40 to 50 $\mu$m after carburization at 1,040° C. for 3 hours and steel containing no Nb is coarsened to 70 to 100 $\mu$m. As has been explained earlier, fining of crystal grains is necessary in view of strength, but it is difficult to fine grains once coarsened in steel.

In the invention, the deterioration of strength due to high temperature carburization is prevented and strength is more positively improved, by significantly fining the crystal grains of the carburized layer through the process of reheating and quenching as explained below. Taking a gear for example, crystal grains are fined at a heating temperature in the region having a depth of (gear module×0.05) or more when measured from the surface, so as to contain 3% by volume cementite having a grain size of 1 $\mu$m or less and have a carbon content of 1.2 wt %. The crystal grains of prior austenite is made to be smaller to have ASTM grain size #9 or more, after reheating and quenching. In the case of a bar subjected to bending stress, the above depth of the grain-fined region corresponds to about 15% of the radius of the bar. This means that the region having a depth at which the maximum stress imposed on the surface decreases by 15%, is reinforced by fining crystal grains. With this arrangement, expensive alloying elements such as Nb are not necessarily added to steel materials, which contributes to low cost manufacture.

The above-described high temperature carburizing method does not substantially require the diffusion process necessary for the conventional vacuum carburizing method, RX carburizing method and $N_2$ base carburizing method. In consideration of the fact that the time required for the ordinary diffusion process is no less than two times as much as the time required for the carburizing phase, the carburizing method according to the invention is remarkably improved in terms of productivity, contributing not only to improved product quality (described later) but also to cost reduction.

Generally, when carburizing time is substantially shortened in the carburizing operation, the time required for raising temperature to a carburizing temperature is prolonged, leading to a decrease in productivity. To cope with this problem, the invention provides a system designed such that a pre-heating chamber used at the preliminary stage of the carburizing phase is disposed separately from the carburizing chamber so that pre-heating operation can be independently carried out under its own temperature condition within an atmosphere of neutral gas or vacuum and such that the pre-heating chamber is interlocked with the carburizing section to increase carburizing operability. Also, the system of the invention includes a gas cooling chamber independent of the pre-heating chamber and the carburizing chamber so that a series of processes: high temperature carburization→conveying of workpieces to the cooling chamber→gas cooling can be carried out in an atmosphere of inert gas or vacuum. Preferably, the gas cooling chamber is equipped with a heat exchanger and the gas chamber can be pressurized up to 10 atmospheric pressure. In view of system cost, it is desirable that the pressure of cooling gas at the time of cooling operation be controlled by a cooling fan so as to fall in the range of from 500 torr to 2 atmospheric pressure.

Since surface carbon content increases to 1.2 to 2.0 wt % after high temperature carburization in the invention, a large amount of platy cementite precipitates in the grain boundary of the carburized layer in the course of the cooling phase. To prevent this cementite precipitation, the carburizing atmosphere is cut off after completion of the high temperature carburization phase and temperature is raised by 50° C. or less, and then the workpiece is conveyed to the above-described cooling chamber to perform rapid gas cooling with inert gas or non-oxidizing gas.

To assure the surface cleanliness of the workpiece for the following phases of reheating carburization and carbonitriding, one or more gases selected from inert gasses including $N_2$, Ar, He and $H_2$ may be used as the cooling gas.

Gas cooling is carried out in the manner described earlier for the following reason. Since the carbon content of the carburized layer of the invention is extremely high compared to the carbon content of the conventional carburized layer, use of quenching oil increases the possibility for cracks. In view of this, most workpieces are treated such that, at least the core structure is not composed of martensite by 100% but chiefly comprises bainite. When such workpieces undergo the above gas cooling, cooling capacity can be easily controlled.

If platy or acicular cementite grains precipitate in the grain boundary of the carburized layer of steel after rapid gas cooling, the cementite grains can be substantially fined in the following reheating phase as far as they are not coarse like the grains precipitating during the high temperature carburization. It is however preferable that the precipitation of the platy cementite in the grain boundary be prevented by the vigorous addition of Al, the adjustment of cooling starting temperature and the adjustment of cooling capacity, which have been described earlier. Where the carburized layer is composed of pearlite, substantial fining can be achieved by incorporating heating at the Al transformation temperature into the heating cycle of the reheating phase, but this technique prolongs the time required for fining. Therefore, it is preferable to adjust the composition of steel such that the main structure is composed of bainite and/or martensite.

Next, there will be explained a high carbon carburizing method in which cementite is allowed to precipitate in the carburized layer in order to increase the rolling strength.

As mentioned earlier, a similar high carbon carburizing method is disclosed in Japanese Patent Publication (Kokoku) No. 62-24499 (1987). According to one embodiment of this publication, after pre-heating at 930 to 980° C., the workpiece is once cooled nearly to room temperature. Then, temperature is raised at a rate of 20° C./min. or less to the temperature range of Ar1 to 950° C. After that, re-carburization is carried out while maintaining the carbon potential equivalent to Acm transformation temperature or more so that 30% by volume or more cementite precipitates in the region having a depth of 0.4 mm from the surface. In this embodiment, the cementite present in the outermost surface is extremely coarsened and the cementite aggregates in the form of long chains as seen from the photographs of the tissue. It is apparent that the extremely coarsened and aggregated cementite causes stress concentration which results in extreme deterioration in the strength of the product. The publication, however, does not discuss this point. Therefore, when producing a compact, high-strength gear for instance, the publication fails in accomplishing its object because even if the strength for withstanding tooth flank pressure is increased, it leads to a decrease in the bending strength of the dedendums.

Using FIG. 4, a study was made to examine the coarsening mechanism of the cementite in the region proximate to the outermost surface in cases where re-carburization was carried out after the above-described preliminary carburization, so as to allow more cementite precipitation, while maintaining a carbon potential equivalent to Acm transformation temperature or more. In the study, steel containing a carbide forming element such as Cr in an amount of $X_M$ was carburized at high temperature with a carbon potential which caused a surface carbon content of ${}^{P1}X_c$ without involving cementite precipitation. After cooling, steel was carburized again. Since the difference ΔXc between the surface carbon content ${}^{0}Xc$ of the austenitic surface structure obtained upon reaching of the re-carburizing temperature in which cementite had already been dispersed and the surface carbon content ${}^{s}X_c$ of the austenite that is in equilibrium during re-carburization with a carbon potential of ${}^{P2}X_c$ was small, the amount of carbon which penetrated and diffused during the re-carburization was extremely small. In addition, most of the penetrating and diffusing carbon was adsorbed by the cementite which had previously dispersed in the surface layer. As a result, the grain size dθ of the dispersed and precipitated cementite was coarsened in inverse proportion to the difference ΔXc. It is understood from the above study that, in principle, coarsening of cementite grains is unavoidable as far as carburization is carried out according to the technique disclosed in the publication. It is anticipated from the comparison between the photographs that re-carburization at 760° C. for instance is effective for fining precipitated cementite, but, in reality, such re-carburization takes very long time, incurring substantial processing cost. In addition, the ordinary RX gas carburizing method may not cause a substantial carburization reaction.

In the prior art high-carbon carburizing technique as shown in FIG. 5 (the carburizing cycle shown in FIG. 5(*b*)), the cementite precipitated in the carburized layer may be coarsened or the aggregation of the cementite due to large amounts of cementite precipitation may be significant. In these cases, there is a good chance that damage may be caused to the tooth flanks at the initial stage, particularly in gears used in high speed rotating conditions.

With a view to overcoming this problem by ensuring the fining of dispersed cementite, the invention provides the following arrangement. The above-described high temperature carburization is carried out thereby increasing the carbon content of the surface carburized layer to 1.2 wt % to 2.0 wt %. Gas cooling is then carried out so that the workpiece has a structure mainly composed of bainite and martensite. Then, the workpiece is once heated at A1 transformation temperature or less to uniformly disperse fully fine cementite (average grain size=0.5 μm or less). Thereafter, the following steps are taken.

① After reheated to a temperature ranging from A1 transformation temperature to 900° C., the workpiece is quenched, thereby allowing cementite dispersion/precipitation such that the depth of the region, where cementite having an average grain size of 1 μm or less is dispersed in an amount of 3% by volume or more, is (gear module×0.05) or more (the bending stress imposed on the outermost surface decreases by 15% at this depth). The crystal grain size is reduced at least to ASTM grain size #9. Cementite having an average grain size of 1 μm or less is dispersed in an amount of 5 to 20% by volume in the region of a carburization depth of 0.05 mm or more. With this, rolling strength and bending fatigue strength are increased.

② The structure, which contains 5 to 20% by volume fine cementite grains dispersed by fining under the conditions of the step ①, is subjected to carbo-nitriding and/or nitriding with a carbon potential equivalent to less than Acm transformation temperature at the re-heating temperature, whereby 20 to 70% by volume residual austenite is created to increase toughness. The martensite created from the residual austenite due to the stress during rotation is made to be finer by the dispersed cementite, thereby increasing rolling strength.

③ While carbonitriding and/or nitriding are again carried out similarly to the step ② to produce 20 to 70% by volume residual austenite, the reaction between the penetrating/dispersing nitrogen and Al is caused to precipitate a nitride having an average grain size of 0.2 μm or less and mainly containing Al in an amount of 15% by volume, thereby increasing rolling strength.

In addition to the steps ①, ②, and ③, the following step is taken for increasing the percentage of fine cementite grains. This step is arranged in consideration of the above described coarsening mechanism of cementite.

④ Reheating carburization and/or carbonitriding are carried out by periodically changing the atmosphere so as to have a carbon potential exceeding the value equivalent to Acm transformation temperature or so as to have a carbon potential that does not exceed the value equivalent to Acm transformation temperature (eutectoid carbon concentration). The crystal grain fining conditions of ①, ②, and ③ are also employed in this step. With this excessive carburization, the cementite proximate to the outermost surface of the carburized layer is prevented from coarsening, thereby dispersing fine cementite of an average grain size of 3 μm or less in an amount of 15 to 35% by volume and an Al nitride in an amount of 0 to 15% by volume, and thereby creating the above-described residual austenite. This measure contributes to an increase in rolling strength and prevents a drop in bending fatigue strength.

In these steps ①, ②, ③, and ④, prior to heating to A1 transformation temperature or more, the workpiece is once heated and maintained at A1 transformation temperature or less. The purpose of this is that after a large amount (up to 30% by volume) of fine cementite is uniformly dispersed within ferrite and elements such as Cr, Mn, Mo and V are rapidly and extremely condensed in the cementite to further stabilize the cementite, temperature is raised to the reheating temperature, thereby making the cementite finer. The same effect can be conceivably achieved, for instance, by gradually raising temperature from 600° C. to A1 transformation temperature at a rate of 5° C./min. or less. When cementite precipitation is caused by re-carburization at temperatures ranging from A1 transformation temperature to 900° C. like the step of ④, the cementite can be prevented from coarsening by the following technique during further cementite precipitation/development: a large amount of nitrogen is diffused in a carbonitriding atmosphere into which ammonia is continuously or intermittently introduced, while performing the normal carbon potential adjustment, so that the carbon potential is increased or varied.

In the technique of quenching after reheating (step ①), heating is preferably carried out in an atmosphere causing no decarbonizing reaction. Whereas, as described earlier, the further fine cementite precipitation caused by the re-carburization of the step ④ is effective particularly in the carbonitriding situation created by adding ammonia into a carburizing atmosphere, use of steel containing large amounts of Ni, Si and Al or steel containing large amounts of Cr and V brings about not only fine cementite precipitation but also the effect of precipitating a fine nitride of 0.2 μm or less (in the case of Al addition), as explained earlier. This effect greatly contributes to improved rolling strength. The combination of the high-carbon carburization for causing fine cementite dispersion and the carbo-nitriding for causing further fine cementite precipitation and/or fine nitride precipitation enables extremely high rolling strength. Further, the effect of improved quenching by dissolving nitrogen in the surface layer; and the residual stress compressing effect obtained by the considerably fine, quenched martensitic structure, the complicated shape of the martensitic structure, the formation of residual austenite, and processing of residual austenite are all effectively utilized in improving rolling strength and bending strength.

The roles of the alloying elements contained in the steel subjected to the high temperature carburization has been heretofore described. Next, the effect of each alloying element for fining cementite during the reheating/quenching phase and the high carbon carburization phase will be explained.

[Cr]

Cr contained in steel takes an important role in fining cementite. Of alloying elements, Cr is most likely to condense in cementite particularly dispersed in ferrite and effectively fines cementite while restricting the development of cementite grains. Cr is the most condensable alloying element next to V, in relation to cementite dispersed in austenite and works on the cementite in austenite similarly to the case of cementite in ferrite. In view of the cementite fining effect, the amount of Cr to be added is preferably 0.3 wt % or more. In cases carbo-nitriding and nitriding are carried out at the reheating temperature, Cr nitrides are likely to precipitate in the grain boundary when the Cr content of the parent phase is 1.5 wt % or more, and therefore, it is necessary to avoid the precipitation of Cr nitrides by reducing the amount of Cr or alternatively by adding 0.2 wt % or more of at least one of the elements Al and V in combination with Cr. If the amount of Cr exceeds 3.5 wt %, $Cr_7C_3$ carbide precipitates in the surface layer and coarse cementite precipitates in the outermost surface layer. This is undesirable in view of rolling strength and bending fatigue strength. For preventing this coarse cementite precipitation, carbon potential needs to be restricted in the ordinary carburization. To this end, the invention utilizes a co-existence of Si and Al according to the following approximation, these elements being proved by the above-noted formula of "Par" to be the most effective elements for restricting cementite precipitation.

$$5.6\times[\text{Si wt }\%]+7.2\times[\text{Al wt }\%]\geqq 2.1\times[\text{Cr wt }\%]$$

It is found from the above relationship that the lower limit of (Si+Al) wt % is 1 wt %. The upper limit of (Si+Al) wt % is preferably 2.5 wt % taking the upper limits of Si and Al (described later) into account.

[V]

The same effects as those of Cr can be obtained with V. For example, V is the third condensable element after Cr and Mn, relative to cementite dispersed in ferrite, and the possible V concentration in cementite is about 10 times the possible V concentration in ferrite. V can more significantly concentrate in cementite dispersed in austenite, compared to Cr. Specifically, the possible V concentration is about 2 times the possible Cr concentration and therefore V has the significant effect of fining and uniformly dispersing cementite. However, V is likely to form VC special carbide and precipitate during high temperature carburization, so that the amount of V to be added for the purpose of fining cementite is limited. Although the effective amount of V in the invention is high compared to the conventional carburization, thanks to the carburization at high temperature, it is preferable to restrict the amount of V to 0.7 wt % or less, in consideration of the conventional test results relating to the solubility products of VC. When carbo-nitriding or nitriding is carried out at a reheating temperature, V reacts with penetrating nitrogen to disperse and precipitate finer carbon nitride V(CN) having an average grain size of 0.3 μm or less. Therefore, V greatly contributes to cementite fining and has the favorable effect of increasing rolling strength by the precipitation of the carbon nitride. In view of the above discussion, the amount of V to be added is preferably 0.1 wt % or more with which the effect of precipitating cementite becomes significant.

[Mo, Mn, Nb, Ti, W]

Apart from Cr and V, consideration should be given to the above carbide stabilizing elements, but Ti, Mo, Nb and W do not have considerable influences upon the stability of cementite and therefore their use may be limited to the production of ordinary case-hardening steel for use in mechanical structures. There is no problem in adding Nb and Ti in the normal range in order to prevent coarsening of crystal grains during high temperature carburization.

[Al, Ni, Si]

In situations where a large amount of cementite is dispersed and precipitated, the above alloy elements such as Cr, Mn, Mo and V condense present in the cementite so that the amount of the alloy elements in the austenite parent phase decreases, causing a considerable drop in the hardenability of the austenite. Taking this into account, it is preferable to add one of the elements Ni, Al and Si, which are more likely to condense in austenite than in cementite, in an amount of 0.1 wt % or more. The upper limit of the amount of Ni is preferably 5 wt % in view of cost, while the upper limits for Al and Si are 2 wt % or less in view of the amount of inclusions existing in the manufacturing process. As has been noted, during carbo-nitriding and/or nitriding at a reheating temperature, Al reacts with penetrating nitrogen, precipitating a large amount of a fine AlN nitride having an average grain size of 0.2 μm or less, which further increases rolling strength.

The nitrogen allowed to penetrate and diffuse on the surface by the carbo-nitriding and/or nitriding at a reheating temperature considerably increases the hardenability of the surface layer and the yield of residual austenite. For ensuring the desirable amount of residual austenite, nitrogen needs to be added in an amount of 0.2 wt % or more and more preferably in an amount of 0.4 wt % or more in order to obtain the more desirable amount of residual austenite, that is, 40 to 60% by volume.

In cases where steel containing an alloying element (e.g., Al) which causes nitride precipitation is used, the condensation of N corresponding to the amount of the alloying element is observed at the surface layer. Taking this into account, the upper limit of N concentration should be determined by the solid solubility of N (0.2 to 0.8 wt %) in the parent layer and the N concentration determined by the limited amount of the nitride. However, the concentration of N in the surface is preferably 0.4 to 2.0 wt %, which is estimated from the maximum concentration of Al that constitutes a substantial proportion of the nitride.

One of the features of the invention resides in that even when temperature is raised to a reheating carburization temperature higher than Al transformation temperature, after a large amount (up to 30% by volume) of the possible finest cementite having an average grain size of 0.2 μm or less has precipitated at a temperature equal to or lower than Al transformation temperature, cementite is prevented from penetrating into the austenite and dispersed in an amount which substantially exceeds the amount (3 to 7% by volume) of cementite in an equilibrium state, whereby the cementite is made finer so as to have a crystal grain size of 12 μm or more to provide a considerably fine grained carburized layer, with a view to improving the strength of tooth flanks and bending fatigue strength. Further, the invention is characterized in that, the number of cores in cementite precipitating in the re-carburization in the reheating carburization step 4 is increased as the fineness of the previously precipitated cementite grains increases, and the number of cores is further increased by carburization and carbo-nitriding at a temperature of 900° C. or less thereby precipitating 10 to 35% by volume cementite having an average grain size of 3 μm or less and preventing coarsening so as to limit the crystal grain size of cementite to less than 12 μm. Cementite is thus dispersed, thereby increasing contact surface pressure strength. If the temperature for the reheating carburization exceeds 900° C., the grain size of precipitated cementite exceeds 3 μm and the aggregation of cementite is increased, with the result that the above-noted notching effect causes a decrease in strength. Therefore, the reheating carburization temperature is set to 900° C. or less. In cases where cementite fining at a temperature equal to or less than Al transformation temperature in the step 4 is not performed, the cementite after the re-carburization is large in grain size. To achieve fine cementite having a grain size of 3 μm or less, high-carbon carburization at a temperature of 800° C. or less is necessary. This conforms to the result reported in the embodiment of the above-explained Japanese Patent Publication No. 62-24499.

While the depth required for fining crystal grains has been discussed earlier, the depth of the re-carburized layer in which cementite is dispersed and the depth of the nitrided layer in which nitrides are dispersed by carbo-nitriding and nitriding may be in the range of 0.05 to 0.5 mm. This value is based on the normal size range of gears used for industrial machinery and obtained taking into account the depth of the position where the maximum shearing stress is exerted, this depth being obtained by the calculation of the Herz's contact pressure of the rolling surface. This is applicable not only to the high-carbon carburization but also to the depth of a fine nitride layer precipitated by carbo-nitriding and/or nitriding.

When carrying out quenching process after dispersion of 10 to 35% by volume spherical cementite, alloying elements such as Cr, Mo, V and Mn condense in high percentage within the cementite, causing a considerable decrease in the hardenability of the parent phase, austenite. Therefore, at least one of the elements which do not condense in cementite such as Ni, Al, Si is preferably added in an amount of 0.2 wt % or more. The upper limit of the amount of Ni to be added is preferably 5 wt % in view of cost while that of Al is 2 wt % or less in view of the amount of inclusions existing in the manufacturing process.

In the invention, it is important to finely disperse and precipitate carbides, carbon nitrides and nitrides by carrying out the carburization and carbo-nitriding of the step 4. This carburization and carbo-nitriding process is preferably followed by cutting off the atmosphere; raising temperature up to 50° C. or less and; and then quenching, whereby the same effect as those of the step 2 can be obtained. Further, the atmosphere is vacuumed thereby dehydrogenating the hydrogen gas components which have been dissolved in the steel from the previous atmosphere. This process is also found to be effective in reducing delay destruction and especially in improving contact surface pressure strength.

BRIEF DESCRIPTION OF DRAWINGS

FIG. 5(*a*) is a microphotograph of a metallic structure of a carburized layer obtained by the prior art high-carbon carburization and FIG. 5(*b*) illustrates a high-carbon carburization cycle.

FIGS. 8(*a*) and (*b*) illustrate the shape of a specimen used for roller pitching tests.

Figure 16:
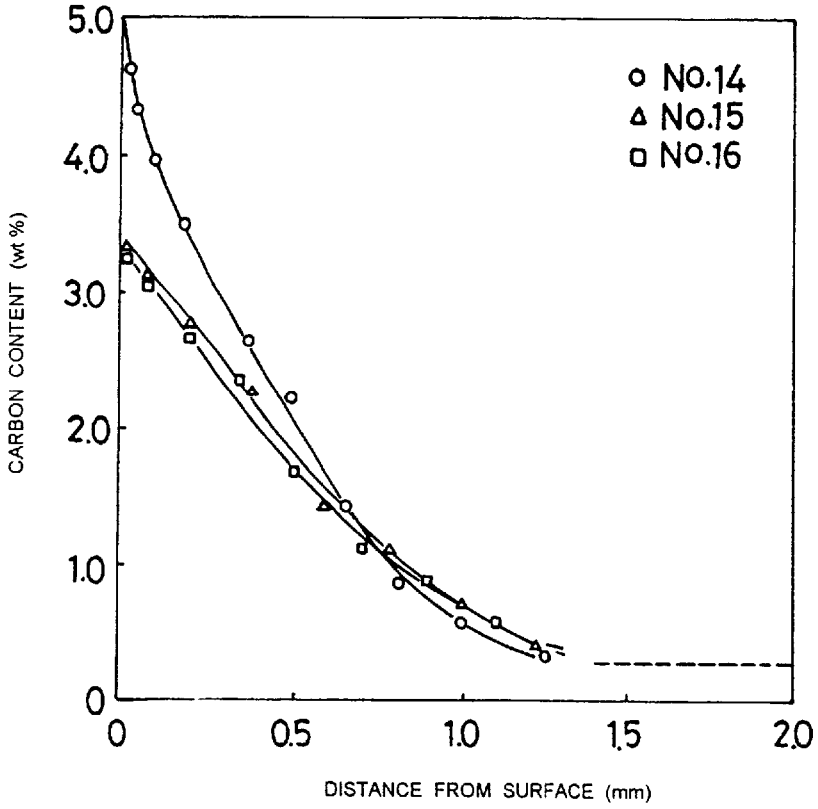
FIG. 16 is a graph showing distributions of carbon concentration of Specimens No. 14, No. 15 and No. 16 when the carburization of FIG. 11 is carried out at a temperature of 1,040° C. for 2 hours.

14 and No. 15, respectively, when carburization is carried out under the conditions of FIG. 16.

Figure 18:
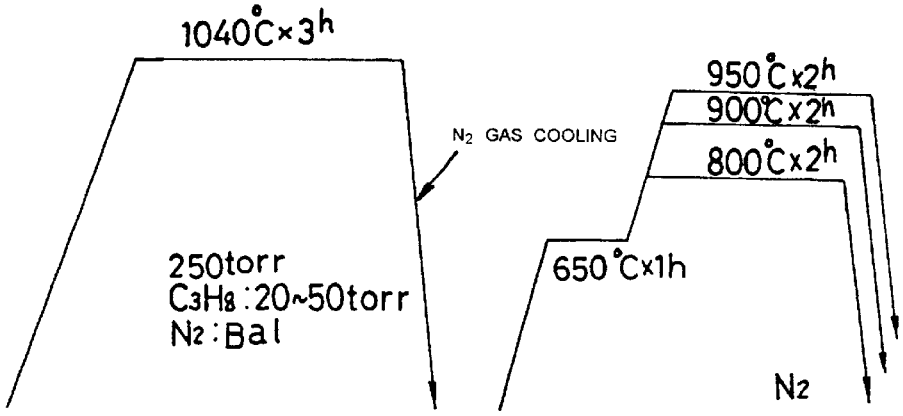

FIG. 18 shows a heating cycle in an embodiment of the invention.

Figure 19:
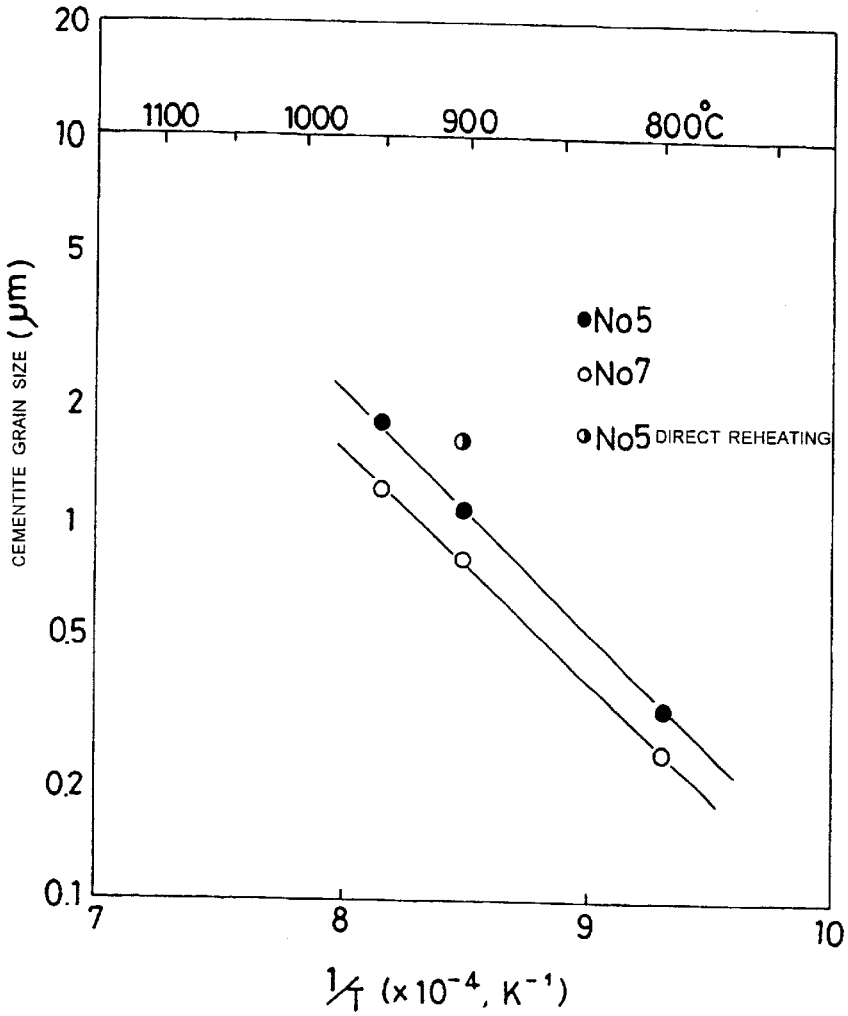

FIG. 19 is a graph showing the relationship between the grain size of cementite in a carburized layer and re-carburization temperature.

Figure 20:
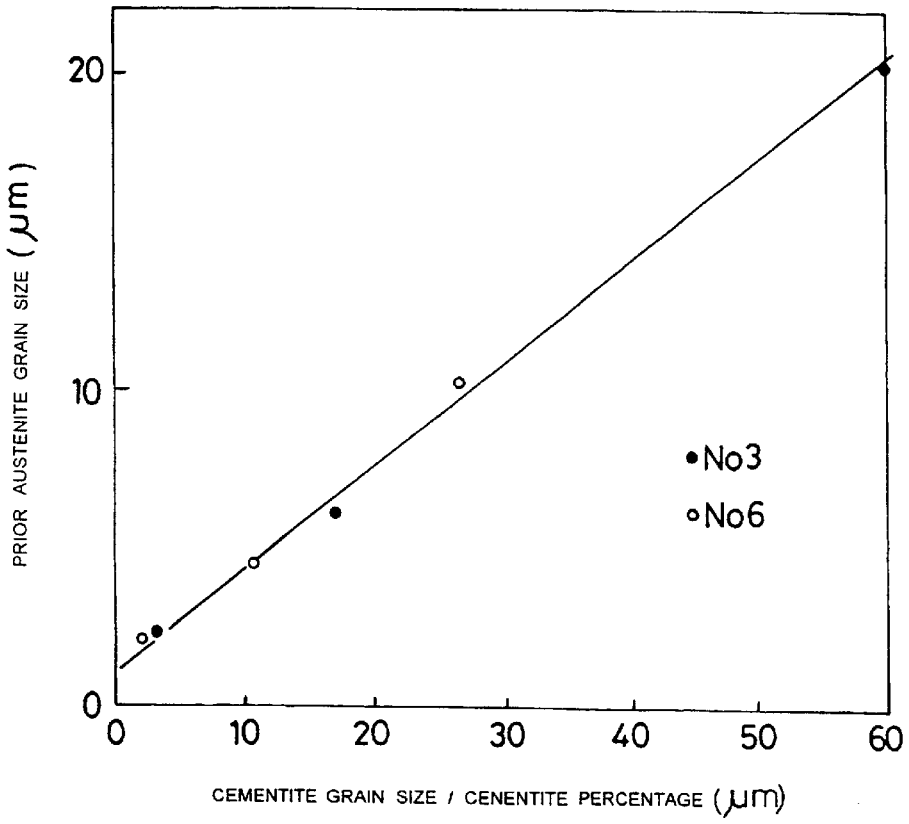

FIG. 20 is a graph showing the relationship between the grain size of prior austenite and the ratio of cementite grain size to cementite percentage.

Figure 21:
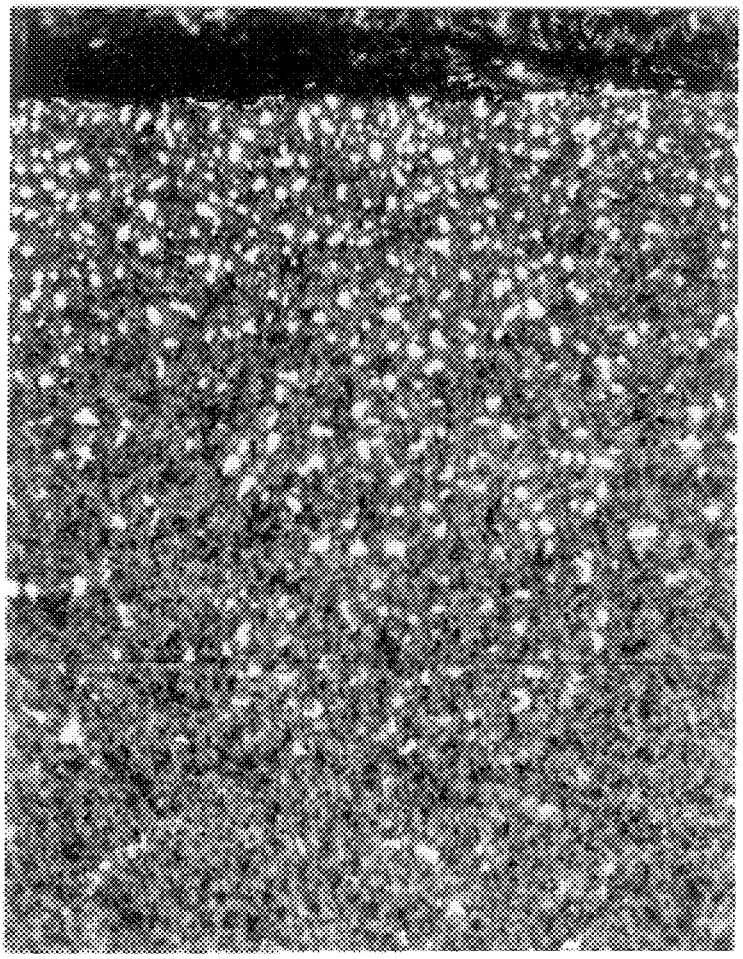

FIG. 21 is a microphotograph of the metallic structure of a high-carbon carburized structure obtained by intermittent addition of ammonia.

Figure 22:
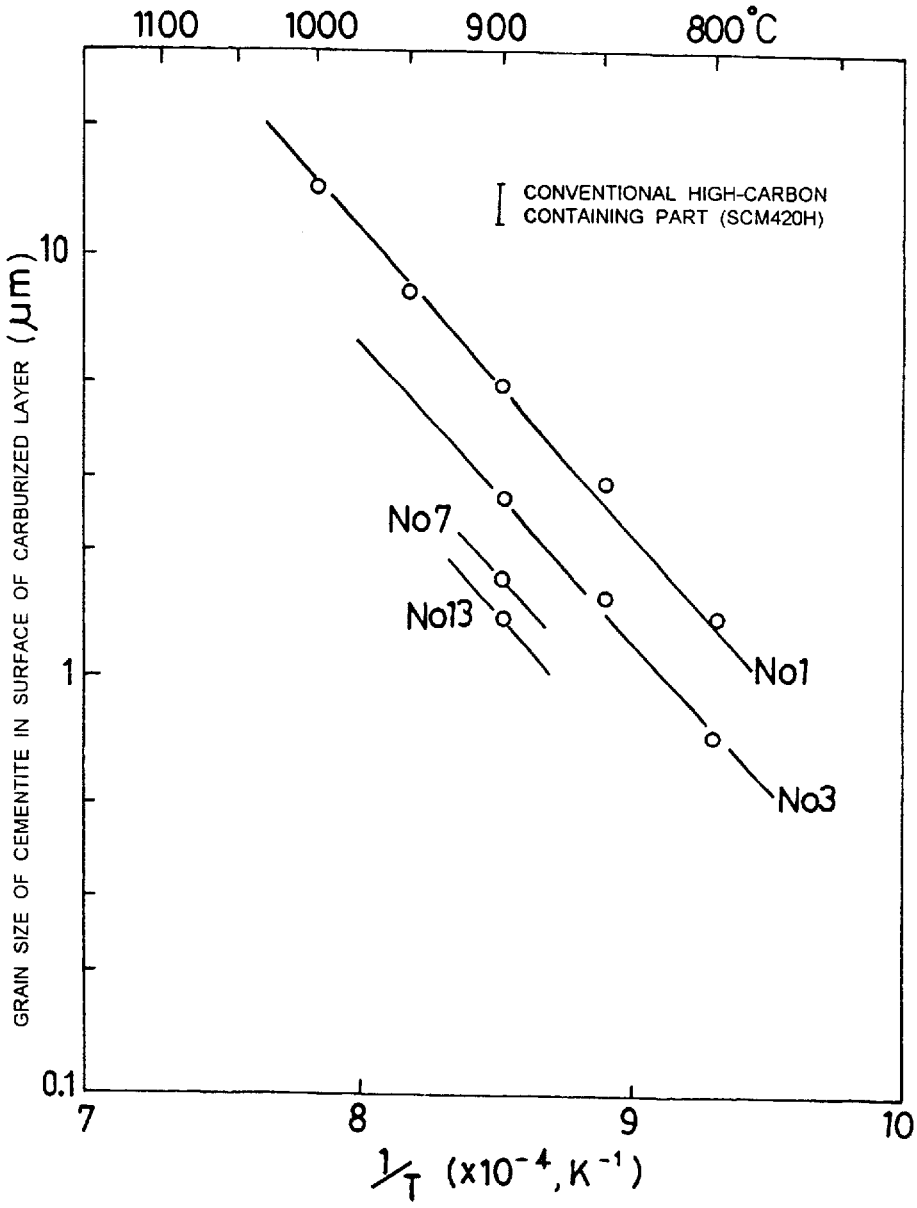

FIG. 22 is a graph showing the relationship between the grain size of cementite in the surface of a carburized layer and re-carburization temperature.

Figure 23:
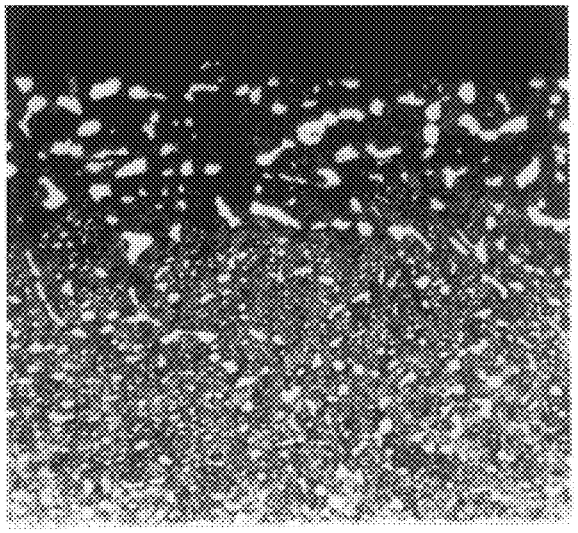

FIG. 23 is a microphotograph of the metallic structure of a gear which is damaged at a tooth flank by the prior art high-carbon carburizing method.

Figure 24:
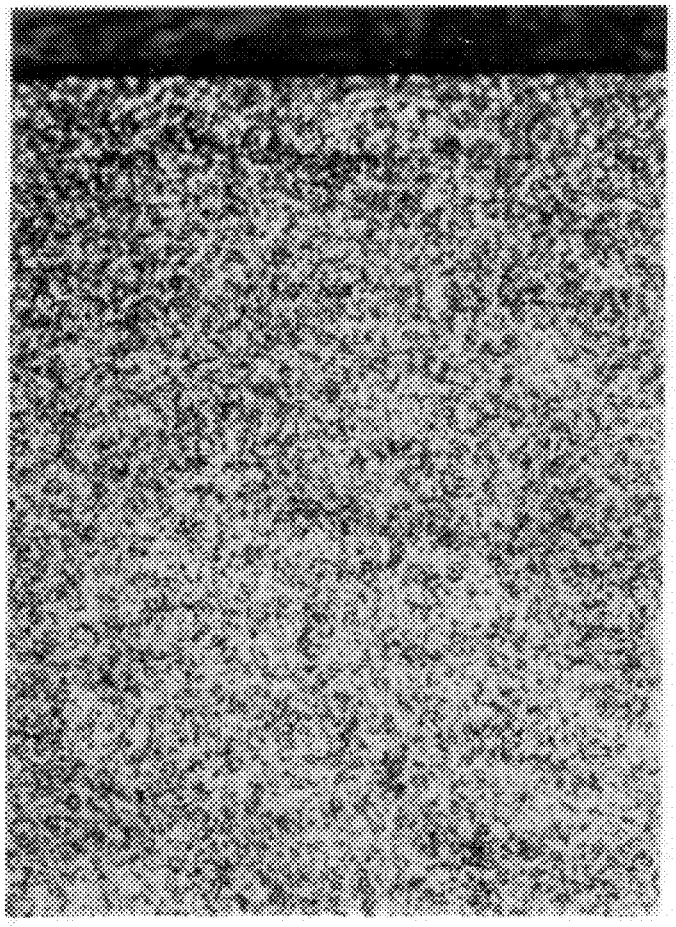

FIG. 24 is a microphotograph of the metallic structure of a carburized structure of Specimen No. 7 when Cr and V are added in high percentage.

Figure 25:
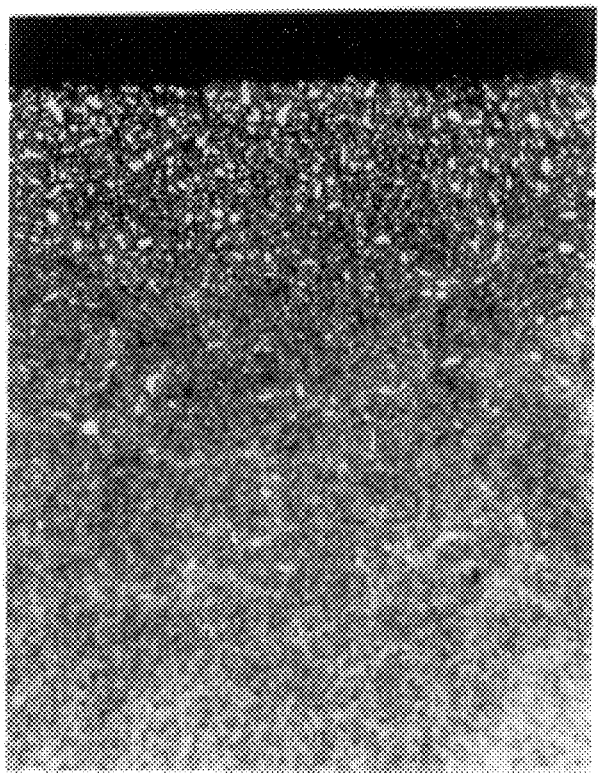

FIG. 25 is a microphotograph of the metallic structure of a carburized structure of Specimen No. 13 when Cr and V are added in high percentage.

Figure 26:
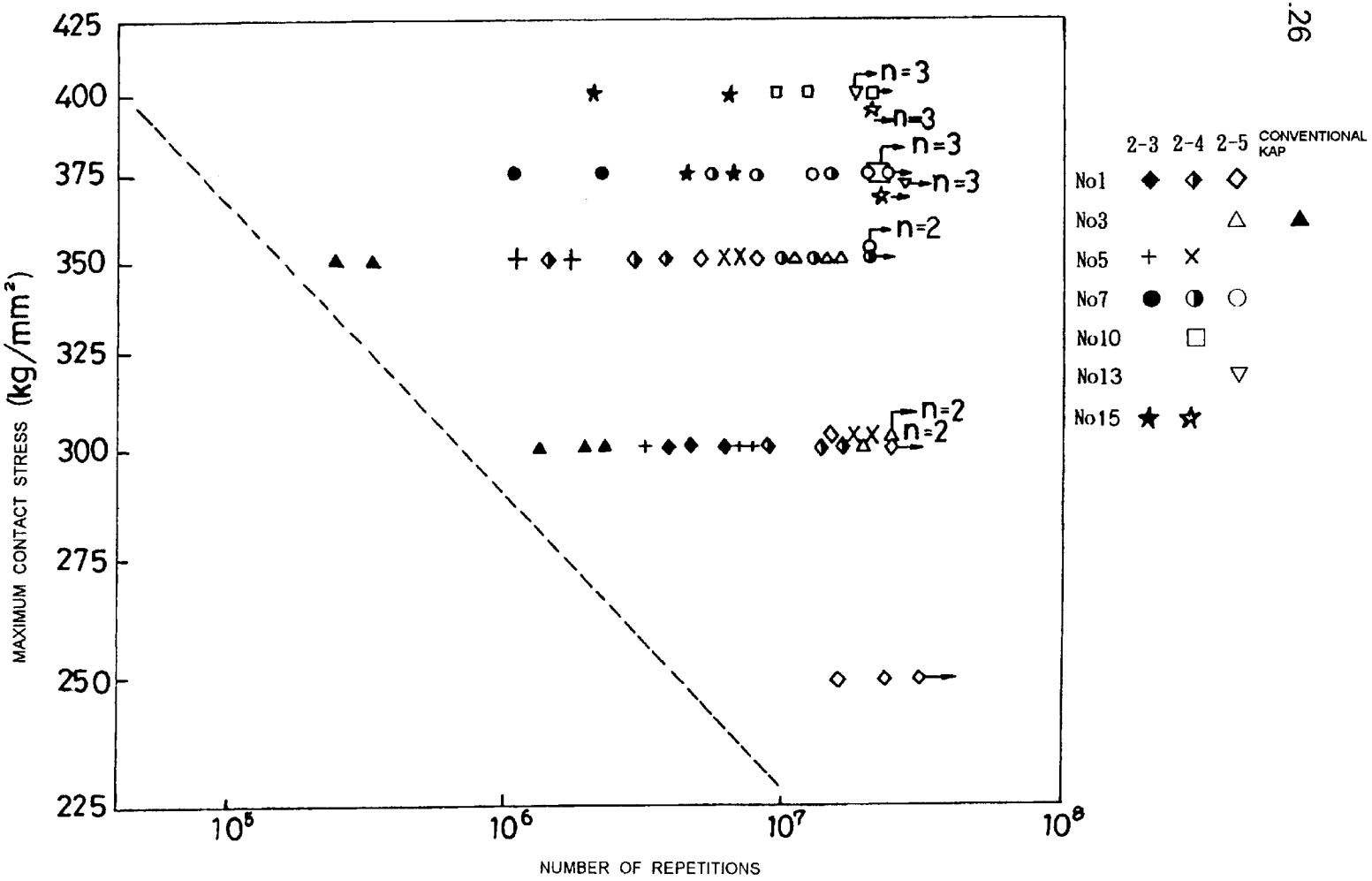

FIG. 26 is a graph showing a test result of rolling contact surface pressure strength.

Figure 27:
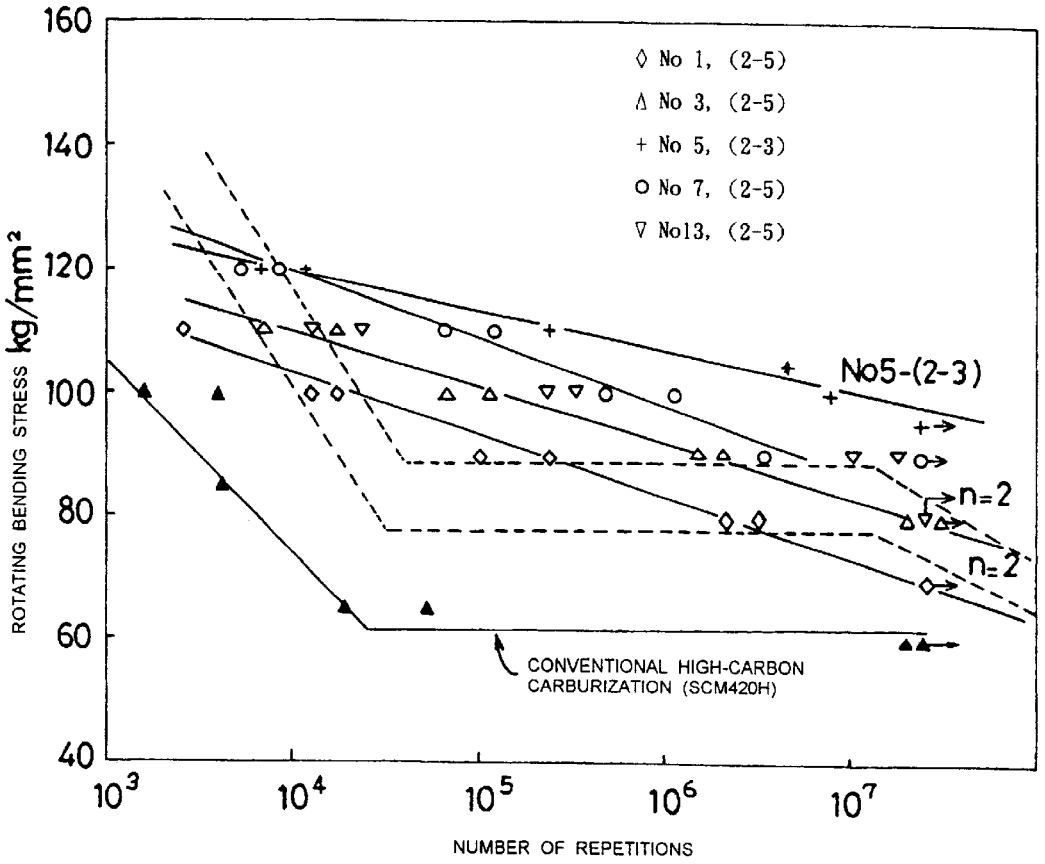

FIG. 27 is a graph showing a test result of rolling bending fatigue strength.

BEST MODE FOR CARRYING OUT THE INVENTION

Referring now to the drawings, preferred embodiments of the invention will be explained.

(1) Preparation of specimens

TABLE 1 shows the chemical composition of each steel specimen used in the invention. The carbon content of each specimen is about 0.2 wt %. This is a typical value for case hardening steel used in production of gears. Commercially available steel materials, SCM420H (No. 3), SNCM220H (No. 4), SNCM420H (No. 5) were also used.

Figure 6:
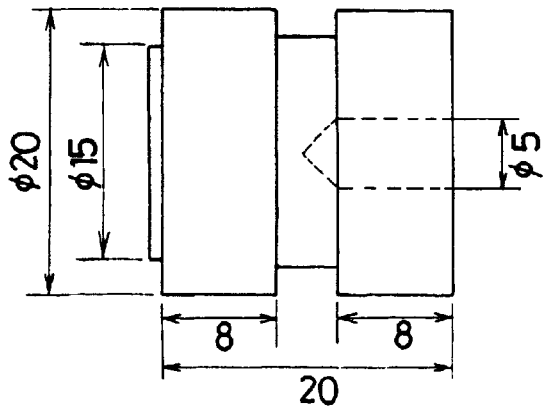
FIG. 6 illustrates the shape of a specimen used for carbon analysis.
Figure 7:
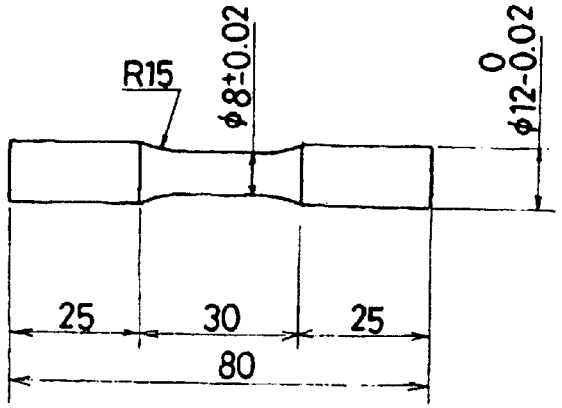
FIG. 7 illustrates the shape of a specimen used for rolling/bending fatigue tests.

The types of the specimens are round bars for carbon analysis, specimens for rolling bending fatigue tests, and specimens for roller pitching tests, which are shown in FIGS. 6 to 8, respectively. The large roller specimens for roller pitching tests were prepared by applying quench-and-temper treatment to SUJ2 so as to have a hardness of $H_{RC}64$.

TABLE 1

COMPOSITIONS OF STEEL SAMPLES

| No | C | Si | Mn | Cr | Mo | V | Ni | Al | Par |
|---|---|---|---|---|---|---|---|---|---|
| 1 | 0.21 | 0.21 | 1.08 | 0.16 | 0.16 | | 0.57 | 0.35 | −2.509 |
| 2 | 0.21 | 0.21 | 1.08 | 1.01 | 0 | | 0 | 0.09 | 1.485 |
| 3 | 0.19 | 0.21 | 0.73 | 1.02 | 0.15 | | | 0.021 | 1.7828 |
| 4 | 0.20 | 0.2 | 0.76 | 0.53 | 0.15 | | 0.58 | 0.02 | 0.328 |
| 5 | 0.19 | 0.21 | 0.58 | 1.01 | 0.16 | | 2.14 | 0.022 | −0.3254 |
| 6 | 0.18 | 0.23 | 0.75 | 1.56 | 0.15 | 0.21 | | 0.018 | 3.7514 |
| 7 | 0.2 | 0.23 | 0.59 | 0.98 | 0.15 | 0.49 | | 0.46 | 0.379 |
| 8 | 0.21 | 0.21 | 0.58 | 1.01 | 0.16 | 0.21 | | 0.02 | 2.518 |
| 9 | 0.2 | 0.22 | 0.65 | 0.52 | 0.15 | | | 0.22 | −0.844 |
| 10 | 0.23 | 0.21 | 0.48 | 1.51 | 0.17 | | | 0.72 | −2.474 |
| 11 | 0.21 | 0.22 | 0.51 | 1.02 | 0.21 | | | 1.02 | −5.642 |
| 12 | 0.19 | 0.21 | 0.54 | 2.13 | 0.16 | | | 0.019 | 3.9302 |

TABLE 1-continued

COMPOSITIONS OF STEEL SAMPLES

| No | C | Si | Mn | Cr | Mo | V | Ni | Al | Par |
|---|---|---|---|---|---|---|---|---|---|
| 13 | 0.22 | 0.08 | 1.01 | 2.81 | | 0.2 | | 1.01 | 0.152 |
| 14 | 0.25 | 0.13 | 0.71 | 13.0 | 0.15 | 0.51 | | 0.024 | |
| 15 | 0.27 | 0.14 | 0.68 | 13.2 | 0.16 | 0.53 | | 0.98 | |
| 16 | 0.26 | 1.35 | 0.69 | 13.1 | 0.15 | 0.51 | | 0.21 | |

(2) Carburization and Carbo-nitriding test

Figure 9:
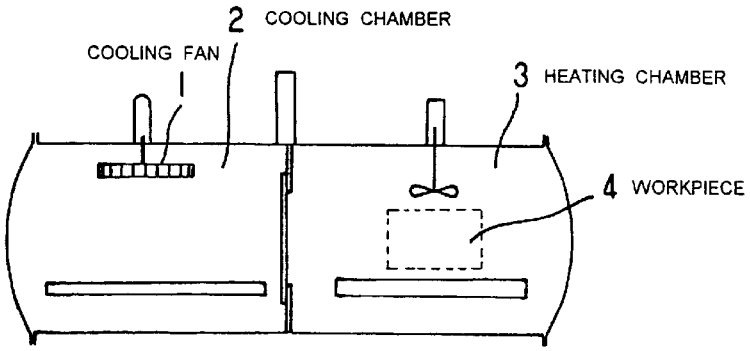
FIG. 9 is a schematic structural view of a carburization furnace.

FIG. 9 schematically shows the internal structure of a carburizing and heating furnace used in this test. The degree of vacuum during heating reached 0.1 torr and the maximum heating temperature was 1,250° C. The furnace is designed to enable pressurizing cooling at 2 atmospheric pressure by use of $N_2$ in a different chamber. The artificial atmosphere of the carburization chamber was directly analyzed by a mass spectrometer, using a sample introducing conduit. The introduction of gas into the mass spectrometer was effected by reducing the measured degree of vacuum of the mass spectrometer to $2\times10^{-7}$ torr.

(2-1) A check on sooting state

Figure 10:
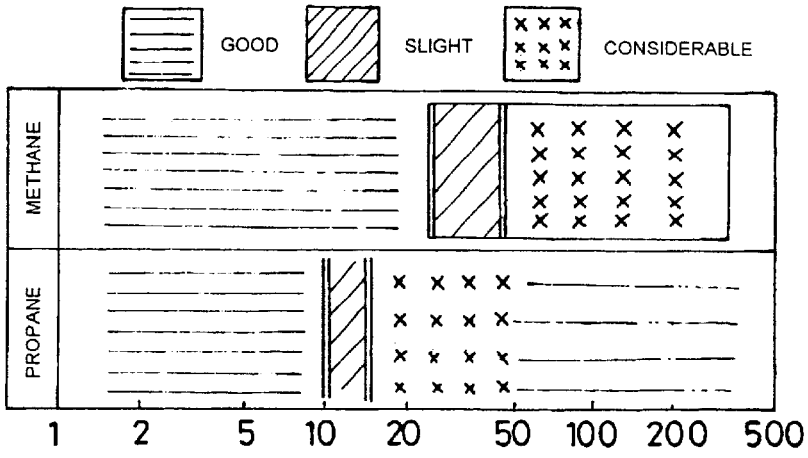
FIG. 10 shows the conditions of soot generation caused by methane and propane.

Tests were conducted at a temperature of 1,040° C. for 1 hour, using specimens No. 3 and propane gas and methane gas respectively as hydrocarbon gas. Atmospheric pressure and sooting state were checked based on the precipitating state of carbon in the specimens and the measurement of carbon by the mass spectrometer. The results are shown in FIG. 10. Obvious soot generation was admitted at a pressure of 10 torr or more when propane gas was used and admitted at a pressure of 25 torr or more when methane gas was used. In both cases, the atmosphere contains each gas in a scarce amount with which carburization on an ordinary scale can be carried out without difficulty. From the comparison in terms of carburization depth at the hole parts of the specimens, it was found that the specimen carburized in an atmosphere of propane gas having a pressure of 10 torr was shallower than the specimen carburized in an atmosphere of methane gas having a pressure of 25 torr. Therefore, a better result could be obtained by use of a mixed gas composed of methane gas having a pressure of 20 torr and propane gas having a pressure of 5 torr. However, it is well known that there often occurs non-uniform carburization in mass production by use of such mixed gas and therefore the flow rate of the gas needs to be increased in order to ensure uniform gas concentration. On assumption that this problem can be solved by increasing pressure to 200 torr or more at which effective gas stirring can be carried out during carburization, a test was conducted in the following way. $N_2$ gas was added to an atmosphere of propane gas having a pressure of 20 torr so as to cause pressure fluctuation by $N_2$ gas within the range of 50 to 200 torr. In a stirred furnace atmosphere, carbo-nitriding was carried out at 1,040° C. for 1 hour. As a result, improved carburizing ability was admitted in the hole part of the specimen.

Based on the same concept, the following situation was checked. While carrying out soot control with $CO_2$ gas, carburization was carried out at a pressure in the proximity of 250 torr with propane gas having a pressure of 200 torr. From the result of such carburization, carburizing ability in the hole part was confirmed.

Effective carburization was observed when propane gas having a pressure of about 20 to 50 torr was introduced and pressure fluctuation within the range of 100 to 200 torr was caused by RX gas, while soot generation being controlled by $CO_2$. It is obvious from this that methanol and/or a mixed gas of methanol+$N_2$ can be used in place of RX gas.

Next, the maximum amount of propane gas which enables control of soot generation when it is used as carburizing gas was checked by carrying out the carburizing heating cycle at 1,040° C. for 1 hour by use of the carburizing test specimen No. 3. When pressure is about 350 torr or more, soot was generated too much to perform soot generation control without difficulty, and creation of grain boundary oxidized layer of 5 $\mu$m or less started in part of the specimen. Although controllability may be improved by adopting an appropriate $CO_2$ gas supply method, no substantial, practical effect can be achieved by increasing the amount of carburizing gas so as to cause a pressure of 250 torr or more. Taking the above discussion and the previous report into account, the amount of propane gas used as carburizing gas is preferably in the range equivalent to 1 to 250 torr. It is the best way in view of cost that while carburizing gas equivalent to 10 to 50 torr being diluted by $N_2$ gas, the flow rate of $N_2$ gas is varied, thereby stirring the furnace atmosphere.

Figure 1:
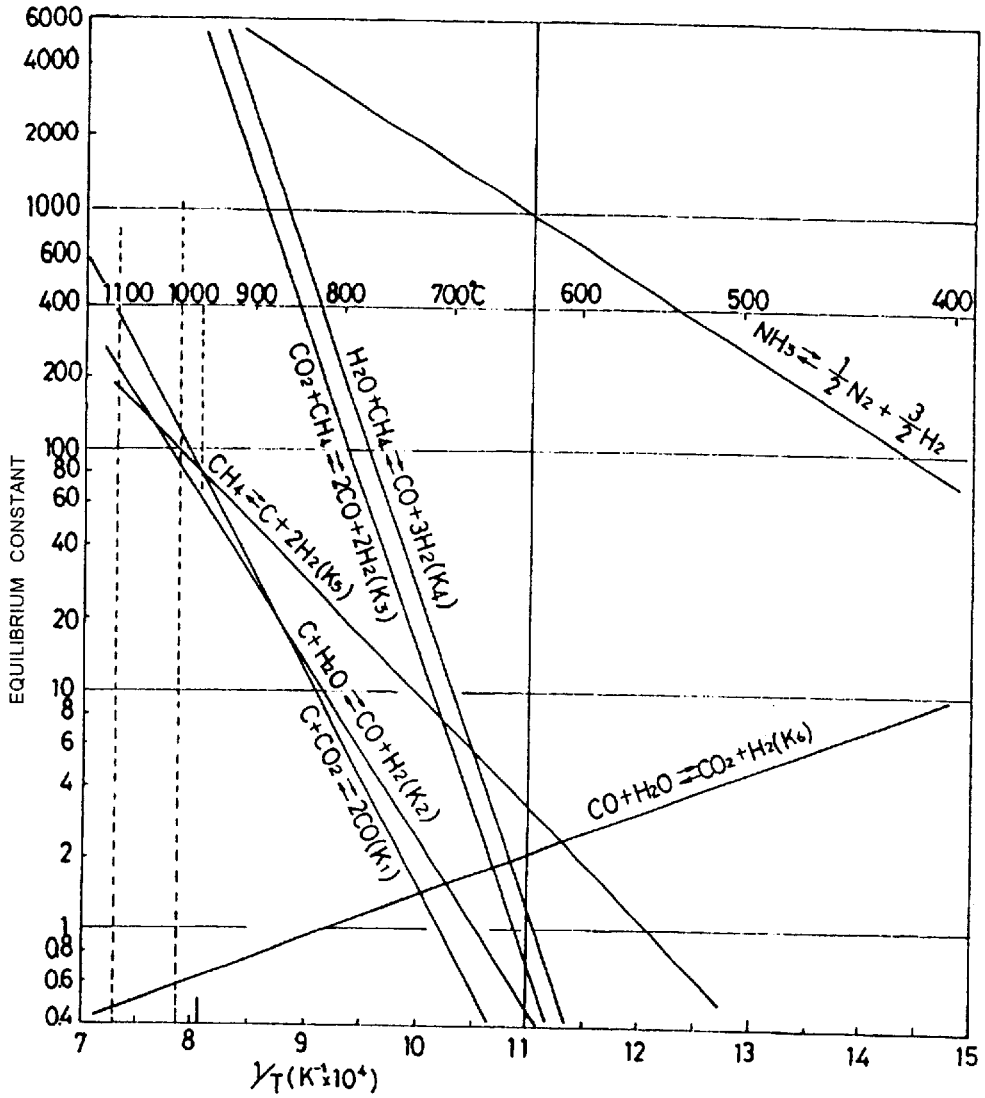
FIG. 1 is a graph showing equilibrium decomposition and composition constants for various gasses.

While $CO_2$ gas is used for the control of soot generation in the above embodiment, it is apparent from FIG. 1 showing the relationship between the gas reaction constants of $CH_4$, CO, $CO_2$, C, $H_2O$, $H_2$ and $NH_3$ that $H_2O$ also has rapid decomposition reactivity with $CH_4$ which is excessively present in a carburizing gas atmosphere. It is also understood from FIG. 1 that $H_2O$ can react, at about 980° C. or more, with the carbon once precipitated within the atmosphere, producing CO more than the amount of carbon precipitating from methane, so that precipitation of carbon within the carburizing chamber can be prevented.

Figure 2:
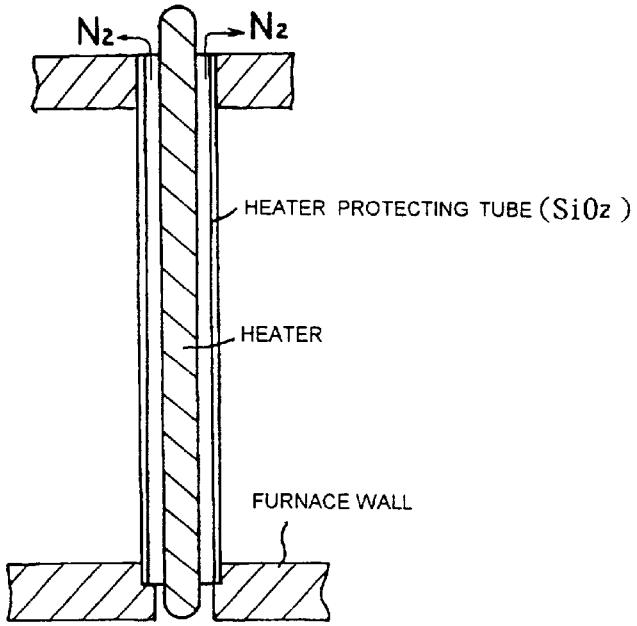
FIG. 2 is a sectional view of a heater provided in a carburization heating chamber.
Figure 3:
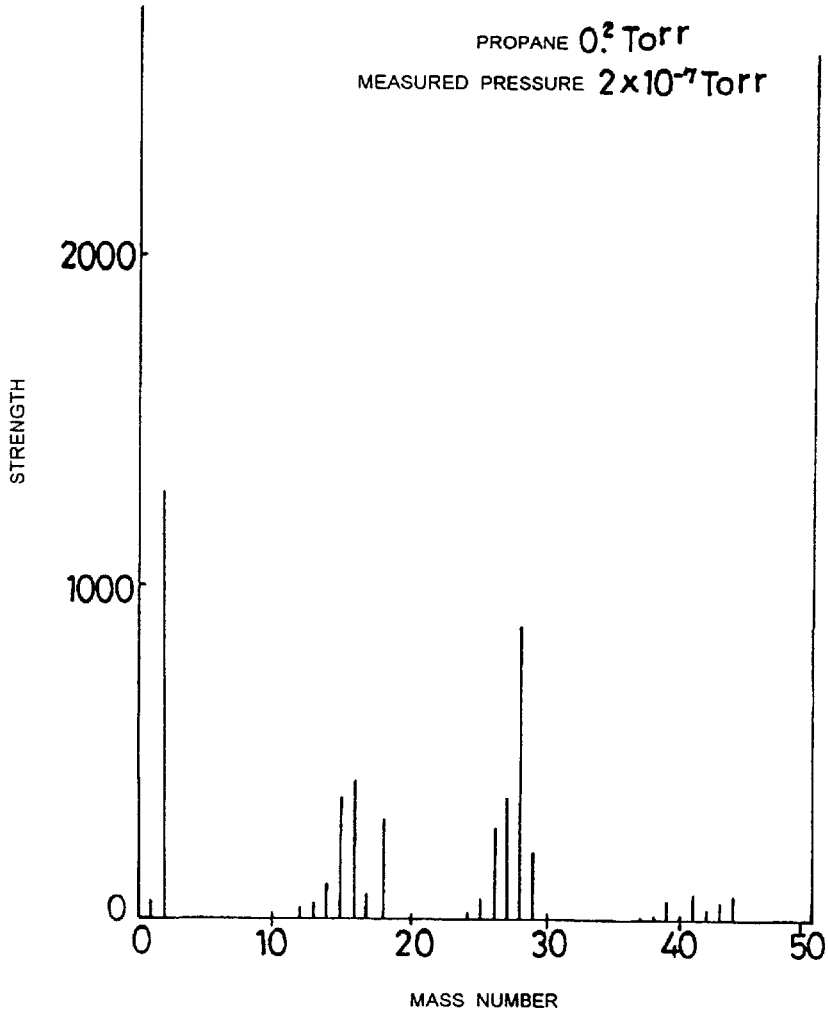
FIG. 3 is a graph showing a result of mass spectrometry conducted in heat-decomposition of propane at a temperature of 1,000° C.

By converting the heater in the carburizing heating chamber as shown in FIG. 2, carbon can be readily removed by oxidation in the event that carbon precipitation occurs within the furnace by accident. This advantage is within the scope of the invention. The protection tube for the heater is designed to allow gas flow and has ends at least either of which is not fixed, because if both ends are fixed, damage due to heating stress during a heating cycle is unavoidable.

(2-2) Test for checking carbon content distribution during carburization

Figure 11:
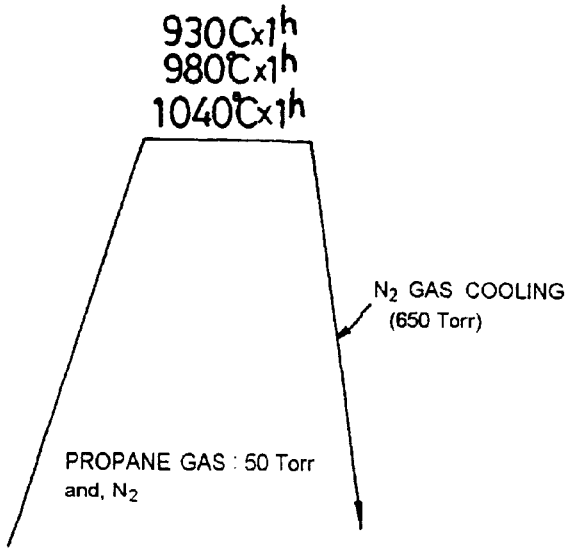
FIG. 11 shows one example of a carburization/heating cycle.
Figure 12:
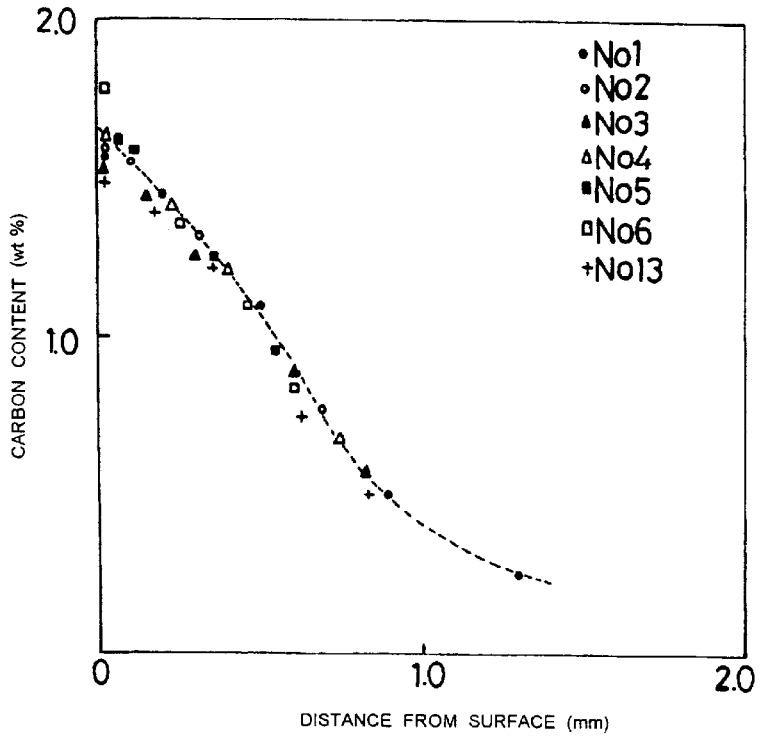
FIG. 12 is a graph of a distribution of carbon concentration when the carburization/heating cycle shown in FIG. 11 is carried out.
Figure 13:
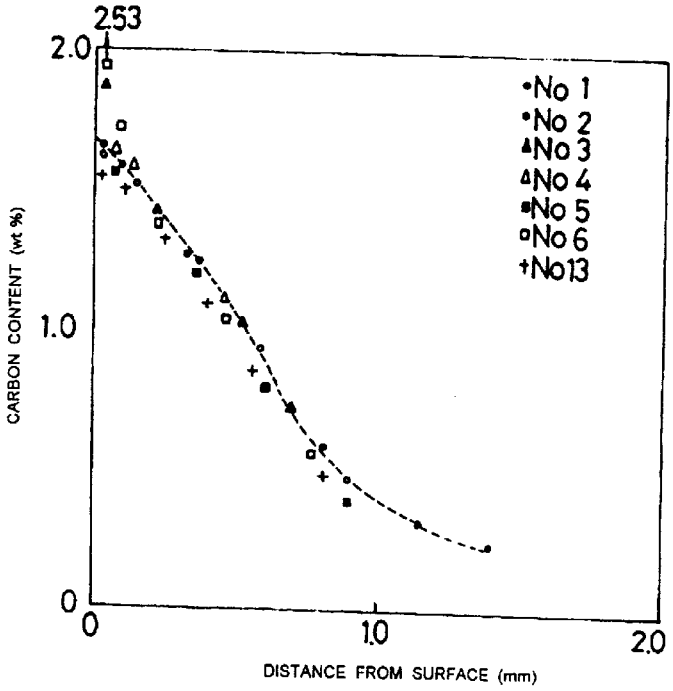
FIG. 13 is a graph of another distribution of carbon concentration when the carburization/heating cycle shown in FIG. 11 is carried out.
Figure 14:
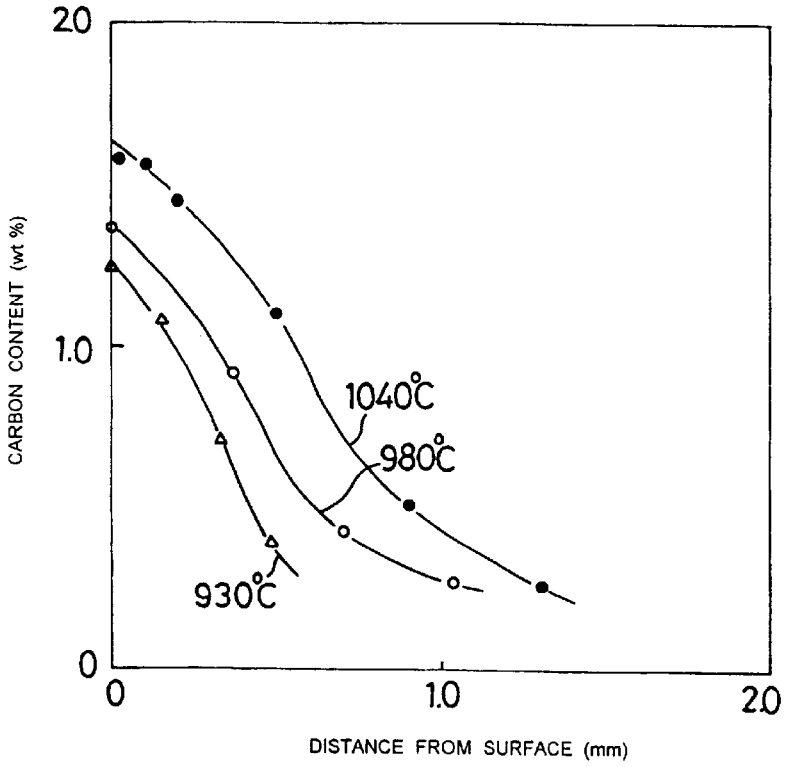
FIG. 14 is a graph of a distribution of carbon concentration of Specimen No. 3 when the carburization/heating cycle shown in FIG. 11 is carried out.

FIGS. 12, 13, and 14 show the distributions of carbon content obtained when the heating cycle shown in FIG. 11 was carried out in an atmosphere (200 torr) prepared by adding $N_2$ gas to propane gas (50 torr) used as carburizing gas.

FIG. 12 shows the result of carburization carried out at a temperature of 1,040° C. for 1 hour, under the carburizing conditions Nos. 1 to 13. In this carburization, soot generation control was not carried out. The broken line of FIG. 12 indicates the distribution of carbon content calculated on assumption that the carbon content of the surface is equal to the solid solubility of graphite relative to Fe. The presence/absence of coarse cementite grains in the surface structure is shown in TABLE 2. It is found from TABLE 2 that coarse cementite is observed in steel materials having a Par value of 1.9 or more.

TABLE 2

PRESENCE/ABSENCE OF CEMENTITE AFTER HIGH TEMPERATURE CARBURIZAION

| No. | A | B | Par. |
|---|---|---|---|
| 1 | ○ | ○ | −2.51 |
| 2 | ○ | ○ | 1.49 |
| 3 | ○(Δ) | x | 1.78 |
| 4 | ○ | ○ | 0.33 |

TABLE 2-continued

PRESENCE/ABSENCE OF CEMENTITE AFTER HIGH TEMPERATURE CARBURIZAION

| No. | A | B | Par. |
|---|---|---|---|
| 5 | ○ | ○ | −0.33 |
| 6 | x | x | 3.75 |
| 7 | ○ | ○ | 0.38 |
| 8 | x | x | 2.52 |
| 9 | ○ | ○ | −0.84 |
| 10 | ○ | ○ | −2.47 |
| 11 | ○ | ○ | −5.64 |
| 12 | x | x | 3.39 |
| 13 | ○ | ○ | 0.15 |

Figure 15:
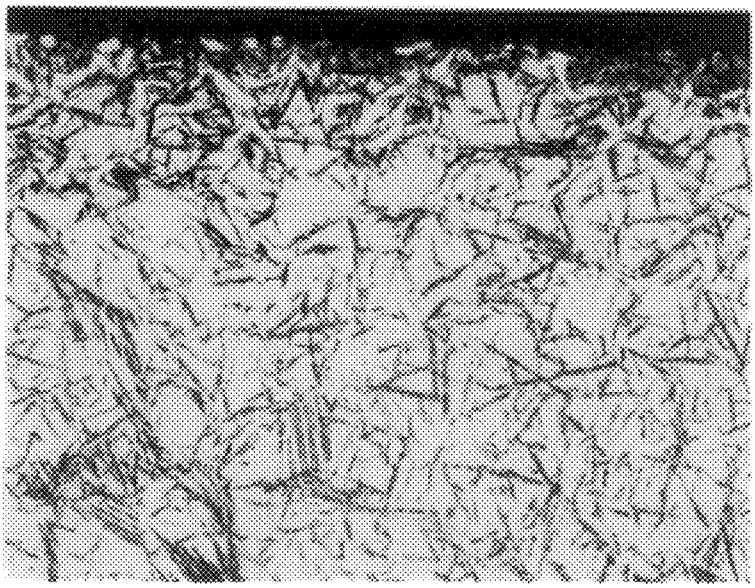
FIGS. 15(*a*) and 15(*b*) are microphotographs of the metallic structures of the surface carburized layers of Specimens No. 3 and No. 10, respectively, when carburization is carried out under the conditions of FIG. 13.
Figure 15:
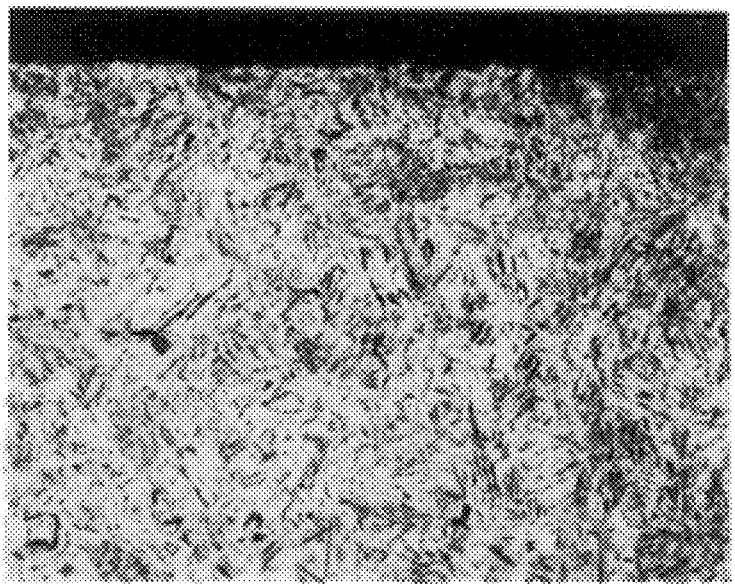

(ABSENCE = ○, PRESENCE = x)
A: PROPANE GAS 50 Torr, 1,040° C. × 1 hr
B: PROPANE GAS 50 Torr + $CO_2$, 1,040° C. × 1 hr FIG. 13 shows the distribution of carbon content obtained when soot generation control was carried out by constantly adding $CO_2$ by piecemeal to the atmosphere under the above conditions in an amount of one fifth of the amount of propane gas or less. The broken line of FIG. 13 indicates the calculated distribution of carbon content similar to the calculated distribution of FIG. 12. FIG. 15(*a*) is a photograph showing the coarse cementite and grain boundary cementite phase (white bright portions are cementite) which precipitated in the surface carburized layer of the specimen No. 3 when carburization was carried out under the conditions of FIG. 13 and followed by cooling with $N_2$ gas. FIG. 15(*b*) is a photograph showing the tissue of the surface carburized layer of Specimen No. 10 when carburization was carried out under the same conditions of FIG. 15(*a*) except addition of Al. The specimen No. 10 differs from the specimen No. 3 in that there is no precipitated cementite and the tissue after cooling does not include only martensite but also a large amount of bainite. The presence/absence of coarse cementite is shown in TABLE 2.

FIG. 14 shows the distributions of carbon content of the specimens No. 3 when carburization was carried out at carburizing temperatures of 930° C., 980° C., and 1,040° C. respectively for 1 hour, under the same conditions as those of FIG. 12.

FIGS. 12 and 13 are identical to each other in that the distribution of carbon content after carburization exactly coincides with the calculated values and therefore these examples are free from factors which cause carburization delay in terms of interface reaction rate controlling, compared to the conventional RX gas carburizing method. It is remarkable that carburization delay was not observed in the cases of FIG. 13 where $CO_2$ was added by piecemeal in order to prevent soot generation. It is also remarkable that when making comparison between the cases where soot generation was not prevented (FIG. 12) and where soot generation was prevented by addition of $CO_2$ gas (FIG. 13), the precipitation of more grain boundary cementite was observed in the specimen No. 3 of SCM420H (see FIG. 15(*a*)) in the latter case than the former case. The reason for this is that the reaction between CO and $CO_2$ gas which has smaller partial pressure is more active than the methane decomposition reaction of $CH_4$ (FIG. 12) under the high temperature carburizing conditions and, accordingly, stronger than the direct carburization reaction of $CH_4$ alone. If $CO_2$ gas is allowed to flow excessively, this apparently causes decarbonization at the surface layer. Therefore, it is preferable to control the addition of $CO_2$ while monitoring the concentration of $CH_4$, $H_2$, $H_2O$ gas within the atmospheric gas and more preferable to control the flow of $CO_2$ in a pulse fashion.

Considerable cementite precipitation was observed in the specimens Nos. 6, 8, and 12 which have relatively large amounts of Cr while cementite precipitation was effectively prevented in the specimens Nos. 2, 7, 9, 10, 11 and 13 to which Al was added in combination.

Figure 4:
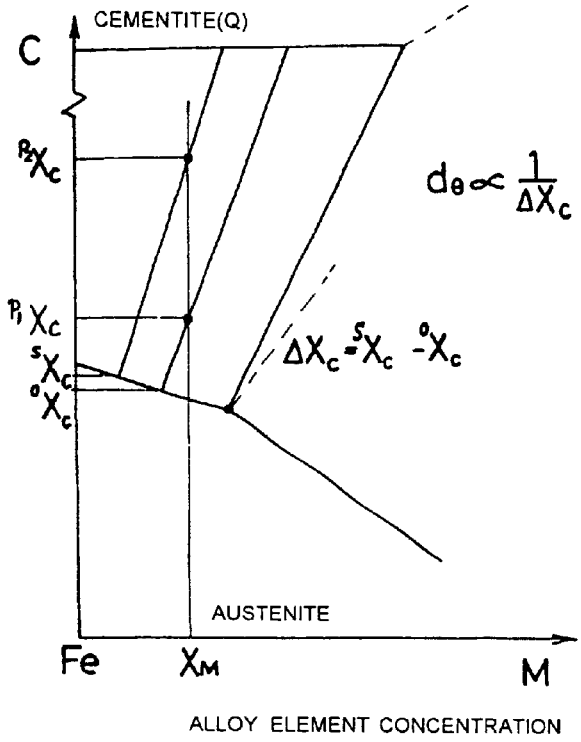
FIG. 4 illustrates the mechanism of cementite precipitation by re-carburization.

It is apparent that the coarse, aggregated tissue as shown in FIG. 5 is observed, when workpieces, which have coarse, aggregated cementite like that of the carburized outermost surface of the specimen No. 3 shown in FIG. 15(*a*), are subjected to the reheating carburization and carbo-nitriding/quenching of the next step 4. In this embodiment, it has been found that such coarse cementite precipitation can be prevented by the following measure: A supply of carburizing gas is stopped prior to gas cooling subsequent to the high temperature carburization shown in FIG. 12 and then temperature is raised in vacuum by 30° C. (to 1,070° C.). The workpiece is held in this condition for 20 minutes (this is one third of the carburizing time) and then cooled. Further, it has been confirmed that such coarse cementite precipitation can be prevented by flowing $CO_2$ gas in an amount equal to one third of the amount of propane gas for 15 minutes to cause decarbonization for a short time, before gas cooling is carried out subsequently to the high temperature carburization shown in FIG. 12. Specifically, where cementite precipitates in the high temperature carburization, such cementite precipitation tends to be concentrated in the vicinity of the outermost surface layer as shown in FIG. 15(*a*). This conforms to the precipitation of coarse cementite in the early explanation of the precipitation mechanism with reference to FIG. 4. Such coarse cementite can be effectively removed by incorporating decarbonization on a very small scale after the high temperature carburization. This does not incur high cost. The formation of the decarbonized layer at the outermost surface is favorable as it has the effect of increasing $\Delta Xc$ in the precipitation of fine cementite during the re-carburization and carbo-nitriding of the later step 4, and has no problem in terms of rolling strength. However, this decarbonization method is preferably applied to steel having a Parr value of 1.9 or less, because this method requires addition of large amounts of Cr or the like and because when Par exceeds 2.5, the region where coarse precipitation occurs is deepened and surface carbon content excessively increases, resulting in prolonged decarbonization time and formation of a significant grain boundary oxidized layer.

As seen from FIG. 14, the surface carbon contents obtained from carburization performed for 1 hour at temperatures of 930° C., 980° C. and 1040° C. substantially correspond to the solid solubility of graphite relative to iron shown in Hansen's constitutional diagram. It has been found that, during carburization without controlling soot generation, carbon activity is controlled to be approximately 1 and temperature is controlled to be 930° C. or more. Cementite precipitation during the high temperature carburization can be prevented by maintaining the following relationship between the components of steel, which has been obtained by analyzing the results shown in TABLE 2.

Figures 17A, 17B:
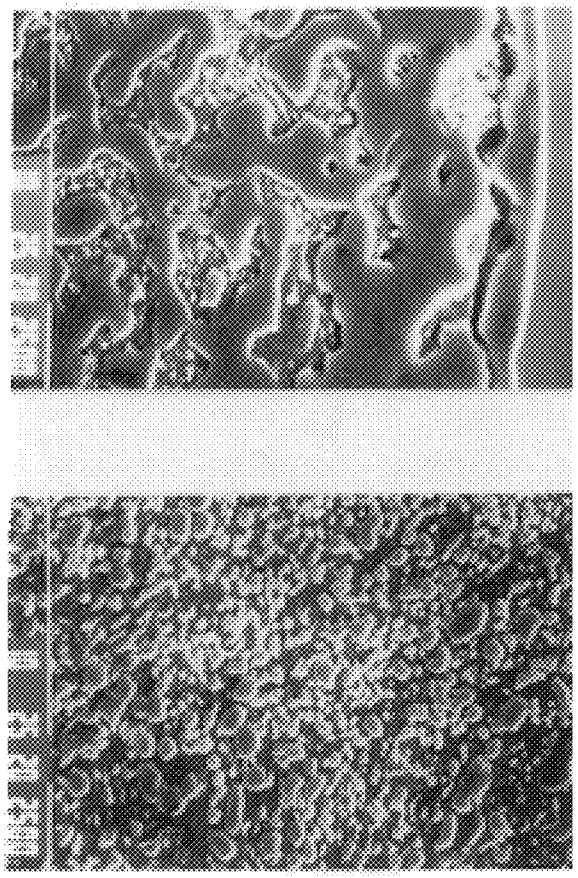
FIGS. 17(*a*), 17(*b*) are microphotographs of the metallic structures of the surface carburized layers of Specimens No.

FIG. 16 shows the distributions of surface carbon content obtained when the specimens Nos. 14, 15 and 16 were carburized in the cycle pattern of FIG. 11 at a temperature of 1,040° C. for 2 hours. Compared to the example shown in FIG. 14, considerable carbon condensation is admitted in these specimens. This is because of fine precipitation of $Cr_7C_3$ caused by addition of Cr in high percentage. Due to the precipitation of coarse cementite during carburization, especially high carbon condensation was observed at the outermost surface layer of the specimen No. 14, compared to the specimens Nos. 15 and 16. In the specimens Nos. 15, 16, coarse cementite precipitation at the outermost surface layer was prevented (as seen form FIG. 17) by addition of Si and Al. In the case of steel containing 3.5 wt % Cr or more in which $Cr_7C_3$ carbide precipitates during carburization, the above-noted coarse cementite precipitation can be prevented by substantially satisfying the relationship described by [Si wt %+Al wt %]≧1.0.

(2-3) Fining of crystal grains in the carburized layer in the step 4.

FIG. 18 shows the heating cycle carried out in this embodiment. The specimens No. 5 (SNCM420H) and No. 7 (steel containing 0.5 wt % V) were carburized in a high temperature carburizing atmosphere created by adding $N_2$ to propane gas (20 to 50 torr) to adjust the atmospheric pressure to about 250 torr. After this carburization was carried out at 1,040° C. for 3 hours, $N_2$ gas cooling (650 torr) was carried out. Then, re-heating was performed in an atmosphere of $N_2$ at re-carburization temperatures of 800° C., 900° C. and 950° C., respectively for 30 minutes. Thereafter, the specimens were subjected to oil quenching. TABLE 3 and FIGS. 19, 20 show the relationship between the prior austenite grain size, cementite grain size, cementite volume percentage of the carburized layers obtained by the above treatment. The specimen No. 7 containing 0.5 wt % V has much finer cementite and austenite crystal grains than those of the specimen No. 5. It is seen from FIG. 20 that there is a substantially linear relationship between the austenite crystal grain size and the ratio of the cementite grain size to the cementite percentage. Additionally, the requirements for the ratio of the cementite grain size to the cementite percentage corresponding to ASTM grain size #9 (i.e., austenite grain size=about 14 μm) are apparent from this figure. It is further understood that when cementite grain size is adjusted to 1 μm, about 2.2% by volume cementite is necessary and that when quenching temperature is 850° C., the above crystal grain fining conditions are approximately satisfied with a carbon content of 1.2 wt %.

TABLE 3

| | No.5 | | | No.7 | | |
|---|---|---|---|---|---|---|
| | AVERAGE GRAIN SIZE OF θ PHASE | PERCENTAGE BY VOLUME OF θ PHASE | AVERAGE GRAIN SIZE OF PRIOR AUSTENITE | AVERAGE GRAIN SIZE OF θ PHASE | PERCENTAGE BY VOLUME OF θ PHASE | AVERAGE GRAIN SIZE OF PRIOR AUSTENITE |
| 800 ° C. | 0.32 μm | 10.8% | 2.4 μm (14.3) | 0.24 μm | 12.1% | 2.2 μm (14.5) |
| 900 ° C. | 1.05 | 6.1% | 6.1 μm (11.5) | 0.79 μm | 7.3% | 4.5 μm (12.3) |

TABLE 3-continued

| | No.5 | | | No.7 | | |
|---|---|---|---|---|---|---|
| | AVERAGE GRAIN SIZE OF θ PHASE | PERCENTAGE BY VOLUME OF θ PHASE | AVERAGE GRAIN SIZE OF PRIOR AUSTENITE | AVERAGE GRAIN SIZE OF θ PHASE | PERCENTAGE BY VOLUME OF θ PHASE | AVERAGE GRAIN SIZE OF PRIOR AUSTENITE |
| 950 ° C. | 1.80 | 3.0% | 20.4 μm (8.0) | 1.2 μm | 4.5% | 10.3 μm (9.8) |

( )ASTM CRYSTAL GRAIN NUMBER

FIG. 19 shows the result of the specimen No. 5 subjected to the heating cycle of FIG. 18. In this test, the stage of heating at 650° C. for 1 hour was omitted and the specimen was heated directly to 900° C. It is understood from this figure that cementite was coarsened in this specimen.

(2-4) Changes in tissue by the reheating/carbo-nitriding treatment

The specimens Nos. 7, 10 and 11 were subjected to the same high temperature carburization and gas cooling as those of (2-3) and then subjected to carbo-nitriding carried out with a carbon potential of 1.0, at a temperature of 850° C. for 2 hours while ammonia being introduced to the atmosphere. The precipitant of Al nitride was found to be fine, having an average grain size of around 0.1 μm. The nitrogen concentration of the surface carbo-nitrided layer was analyzed by EPMA. It is found from the analysis that as the amount of Al increased, substantially all of Al precipitated and that the amount of nitrogen dissolved in the parent phase was about 0.6 wt % and that the maximum amount of nitrogen was about 7% by volume (the specimen No. 11). The dispersing amount of cementite at that time was about 10% by volume.

(2-5) Changes in tissue by reheating/high carbon carbo-nitriding treatment

The specimens Nos. 1, 3, 7 and 13 were subjected to high temperature carburization and gas cooling under the same conditions as those of (2-3). Then, they were treated at 900° C. for 2 hours, while flow control for ammonia being carried out so as to allow or stop a supply of ammonia. Specifically, it was arranged such that when no ammonia flew, the carbon potential was fixed at 0.9 and when ammonia flew intermittently, the maximum carbon potential was 2.0. FIG. 21 shows the dispersing state of cementite in the specimen No. 1 in which no coarse cementite is observed in the carburized layer. FIG. 22 shows the relationship between the grain size of the cementite precipitant and re-carburizing temperature. For comparison, FIG. 23 shows the tissue of the specimen No. 3 which was subjected to high-carbon carburization in which no ammonia was allowed to flow, keeping carbon potential at 2.0. FIGS. 24, 25 show the carburized tissues of the specimens Nos. 7 and 13 containing Cr and V in high percentage.

(3) A study of rolling contact surface pressure strength

Tests were conducted on the roller pitching specimens of the type shown in FIG. 8 to check their strength for withstanding rolling contact surface pressure under the conditions that the rotating speed of the small roller was 1,000 rpm, slip ratio was 40% and oil temperature was 60° C. The specimens used herein were the specimens Nos. 1, 3, 7 and 13 which had undergone heat treatment under the conditions of (2-5); the specimen No. 3 (KAP shown in FIGS. 23 and 24) which had undergone the high-carbon carburization without a flow of ammonia gas; the specimens Nos. 1, 5, 7, 10 and 15 which had undergone heat treatment under the conditions of (2-4); and the specimens Nos. 1, 5, 7 and 15 which had undergone heat treatment under the conditions of (2-3). Test results are shown in FIG. 26. The broken line in this figure indicates the substantial B 10 life of the rolling contact surface of the material SCM420H to which the conventional carburization was applied (surface carbon content=0.8 wt %). It is understood from these results that all of the specimens containing fine cementite are improved in rolling strength over the specimens treated by the conventional high-carbon carburizing method and containing coarse cementite. Also, the effect of the improved residual austenite on the dispersed, precipitated cementite can be admitted and this effect is remarkable particularly in the heat-treated specimens which underwent carbo-nitriding with addition of Al under the conditions of (2-4). The effect of dispersion/precipitation of $Cr_7C_3$ and AlN can be admitted in the specimen No. 15 containing Cr in high percentage.

(4) A check of rolling/bending fatigue strength

Tests were conducted on the specimens ("ONO rolling/bending fatigue test specimens") shown in FIG. 7 to check the strength for withstanding rolling/bending fatigue. The types of the specimens used herein were selected from the standard types used in the tests of the column (3). The test results are as shown in FIG. 27. As seen from this FIGURE, the fatigue strength of the conventional high-carbon carburized steel (Specimen No. 3) containing coarse cementite was considerably poor, compared to the fatigue strength (indicated by broken line) of the SCM420H material which underwent the conventional ordinary carburization arranged to provide a surface carbon content of 0.8 wt %. In contrast with this, the specimens containing fine cementite and fine crystal grains did not decrease in strength. It is seen from, for instance, the specimens No. 7 (2-5) and No. 13 (2-5) that the effect of fining crystal grains highly contributes to an improvement in fatigue strength.

What is claimed is:

1. A carburized part produced by carburizing a steel workpiece in an atmosphere having a carbon potential adjusted so that the surface carbon content of the workpiece becomes 1.2 to 2.0 wt %, preventing cementite precipitation at a surface layer of the workpiece during the carburization, and then cooling the workpiece to a temperature equal to or lower than Al transformation temperature and reheating the workpiece so that 5 to 20% by volume cementite having an average grain size of 1 μm or less disperses and precipitates in the carburized surface layer and the grains of said dispersed, precipitated cementite make austenite crystal grains present in the carburized layer finer, so that said austenite crystal grains have a grain size equal to or higher then ASTM grain size #9, the steel workpiece containing 0.2 to 2.0 wt % Al and having the composition satisfying the requirement described by $1.9 \geqq -5.61(\text{Si wt \%}) - 7.2(\text{Al wt \%}) + 1.1$ (Mn wt %)+2.1(Cr wt %)−0.9(Ni wt %)+1.1(Mo wt %)+0.6(W wt %)+4.3(V wt %), when the amount of Cr is 3.5 wt % or less.

2. A carburized part by carburizing a steel workpiece in an atmosphere having a carbon potential of 1.2 wt % or more so as to disperse and precipitate, in a surface layer of the workpiece, 35% by volume or less special carbides $Cr_7C_3$ and $V_4C_3$ having an average grain size of 1 μm or less, cooling the workpiece to a temperature equal to or lower than Al transformation temperature and reheating the workpiece, and carbo-nitriding and/or nitriding the workpiece during the reheating process so that one or more kinds of fine nitrides/fine carbon nitrides containing at least AlN having an average grain size of 0.5 μm or less are dispersed and precipitated in addition to fine cementite and/or special carbides dispersed and precipitated in addition to fine cementite and/or special carbides dispersed and precipitated in addition to fine cementite and/or special carbides $Cr_7C_3$ and $V_4C_3$ austenite crystal grains in the surface layer of the workpiece are fined to have a grain size equal to or higher then ASTM grain size #9, the steel workpiece comprising, at least Al in an amount in the range of 0.2≦(Al wt %)≦2.0; Cr in an amount in the range of 3.5<(Cr wt %)≦15; and Si in an amount which satisfies the requirement represented by 1.0≦(Si wt %+Al wt %)≦2.5.

3. A carburized part according to claim 1 wherein, by carbon-nitriding and/or nitriding the workpiece during the reheating process, one or more kinds of fine nitrides/fine carbon nitrides containing at least AlN having an average grain size of 0.5 μm or less are dispersed and precipitated in addition to fine cementite and/or special carbides $Cr_7C_3$ and $V_4C_3$ and austenite crystal grains in the surface layer of the workpiece are fined to have a grain size equal to or more than ASTM grain size #9.

4. A carburized part according to claims 2 or 3, wherein carbides originally precipitated in the surface layer are utilized as cores to increase the amount of precipitated carbides having an average grain size of 3 μm or less up to 35% by volume, by carbo-nitriding and/or nitriding while fluctuating carbon potential between the eutectoid carbon content and the carbon content equivalent to Acm transformation temperature during the reheating process.

5. A carburized part according to claim 3, wherein said nitrides and/or said carbon nitride are dispersed and precipitated and 20 to 70% by volume residual austenite is formed in the surface layer after quenching, by carbo-nitriding and/or nitriding the workpiece during the reheating process.

6. A carburized part according to claim 3, wherein said fluctuation of carbon potential is carried out by controlling the amount of ammonia introduced into the atmosphere.

7. A carburized part according to claim 1 or 2, wherein the temperature of the carburization which is free from cementite precipitation and provides a surface carbon content of 1.2 to 2.0 wt % is 980° C.

8. A carburized part according to claim 1 or 2, which is used as a gear and in which where the austenite crystal grains in the carburized layer is fined, the depth of the region having a carbon content of 1.2 wt % in the carburized layer is equal to or more than the value obtained by multiplying the module M of the gear (m/m) by 0.05, and the austenite crystal grains in said region has a grain size equal to or more than ASTM grain size #9.

9. A method for producing the carburized part as set forth in claim 1 or 3, the method comprising:

(a) the first step of pre-heating a steel workpiece to a temperature equal to or higher than Al transformation temperature;

(b) a second step of carburizing the workpiece at a high temperature of 980° C. or more in an atmosphere having a carbon potential ranging from 1.2 to 2.0 wt %;

(c) a third step of rapidly cooling the workpiece to a temperature equal to or lower than Al transformation temperature, using a gas cooling medium;

(d) a fourth step of reheating the workpiece during which 18 to 30% by volume fine cementite grains are dispersed at a temperature equal to or lower than Al transformation temperature, and 5 to 20% by volume cementite grains having an average grain size of 1 μm or less are dispersed at a temperature within the range of from Al transformation temperature to 900° C., thereby fining the crystal grains of austenite; and (e) a fifth step of quenching the workpiece, whereby a carburized layer that mainly comprises martensite and the cementite grains is obtained.

10. A carburized part producing method according to claim 9, wherein, in the reheating of the fourth step, carbo-nitriding and/or nitriding is conducted at a temperature ranging from Al transformation temperature to 900° C.; thereby dispersing and precipitating, in the surface of the carburized layer, fine cementite having an average grain size of 3 μm or less and/or nitrides having an average grain size of 0.5 μm or less and/or carbon nitrides having an average grain size of 0.5 μm or less; further dispersing and precipitating cementite and/or nitrides and carbon nitrides in an amount of 5 to 35% by volume; and rapidly cooling the workpiece from a temperature equal to or more than Al transformation temperature.

11. A carburized part producing method according to claim 9, wherein, in the fourth step, an element selected from the group consisting of Cr, Mn, V, Mo and W is allowed to condense in cementite precipitated in ferrite, by uniformly heating the workpiece at a temperature equal to or lower than Al transformation temperature and/or raising heating temperature at a rate of 5° C./min. from 600° C. to Al transformation temperature, whereby the cementite is fined, and wherein the re-dissolving rate of the cementite brought into an austenite state by heating is lowered thereby to prevent the aggregation and development of the cementite.

12. A carburized part producing method according to claim 10, wherein the precipitation of the cementite is prevented to disperse and precipitate $Cr_7C_3$ carbide and $V_4C_3$ carbide having an average grain size of 1 μm or less during the high-temperature carburization of the second step, and after cooling similarly to the third step, one or more kinds of nitrides and/or carbon nitrides containing at least AlN having an average grain size of 0.5 μm or less is dispersed and precipitated, and 20 to 70% by volume residual austenite is produced in the fourth step.

13. A carburized part producing method according to claim 10, wherein the gas cooling of the third step is rapidly carried out by use of one or more gases selected from the group consisting of $H_2$, $N_2$, Ar and He, such that at least the carburized, carbo-nitrided layer has one or more structure selected from martensite, bainite and fine pearlite structures.

14. A carburized part producing method according to claim 10, wherein, in the fourth step, after the carbo-nitriding and/or nitriding, the furnace atmosphere is changed to an atmosphere selected from the group consisting of $N_2$, Ar and vacuum atmosphere and the workpiece is heated in this atmosphere so that the workpiece is dehydrogenated.

15. A carburized part producing method according to claim 9, wherein as a means for creating the atmosphere of the high-temperature carburization of the second step, carburization is carried out in an atmosphere of one or more kinds of hydro-carbon gas having a partial pressure of 250 torr or less and/or carburization is carried out under a reduced pressure of 600 torr or less created by introducing inert gas selected from the group consisting of $N_2$, Ar and He into the furnace, while reducing the non-uniformity of carburization in terms of the posture of the workpiece and the shape of the workpiece by intermittently introducing inert gas selected from the group consisting of $N_2$, Ar and He into the furnace to stir the gas within the furnace, and while providing a carbon activity of approximately 1 by generating a small amount of soot under control by increasing the temperature of the carburization to 980° C. or more to increase the heat decomposition ability of the hydro-carbon gas.

16. A carburized part producing method according to claim 15, wherein the quantitative control of carbon precipitation by the gas decomposition reaction caused in the high temperature carburizing atmosphere is carried out by controlling the quantity of hydrocarbon gas and/or ammonia gas and/or by intermittently introducing $CO_2$ gas and alcohols under control.

17. A carburized part producing method according to claim 15, wherein, during the high temperature carburization, the non-uniformity in carburization due to variation in the posture and shape of the workpiece is reduced by intermittently introducing inert gas selected from the group consisting of $N_2$, Ar and He into the furnace thereby causing pressure fluctuation to stir the gas within the furnace.

* * * * *